United States Patent [19]

Hempkins et al.

[11] Patent Number: 4,791,998

[45] Date of Patent: Dec. 20, 1988

[54] METHOD OF AVOIDING STUCK DRILLING EQUIPMENT

[75] Inventors: W. Brent Hempkins, San Francisco, Calif.; Roger H. Kingsborough, Kingwood, Tex.; Wesley E. Lohec, Harvey, La.; Conroy J. Nini, Midland, Tex.

[73] Assignee: Chevron Research Company, San Francisco, Calif.

[21] Appl. No.: 935,510

[22] Filed: Nov. 26, 1986

Related U.S. Application Data

[63] Continuation-in-part of Ser. No. 756,307, Jul. 15, 1985, abandoned.

[51] Int. Cl.[4] ..... E21B 7/00; E21B 7/04

[52] U.S. Cl. ..... 175/61; 175/65

[58] Field of Search ..... 175/61, 65, 25, 38; 166/301

[56] References Cited

U.S. PATENT DOCUMENTS

| | | | |
|---|---|---|---|
| 3,152,642 | 10/1964 | Bodine, Jr. | 166/301 |
| 3,552,502 | 1/1971 | Wilson, Sr. | 175/38 |
| 3,811,509 | 5/1974 | Priebe | 175/65 X |
| 4,298,078 | 11/1981 | Lawrence | 175/72 |
| 4,384,625 | 5/1983 | Roper et al. | 175/56 |
| 4,423,791 | 1/1984 | Moses, Jr. | 175/65 |
| 4,427,080 | 1/1984 | Steiger | 175/40 X |
| 4,428,441 | 1/1984 | Dellinger | 175/61 |
| 4,685,329 | 8/1987 | Burgess | 73/151 |

OTHER PUBLICATIONS

T. E. Love, Oil and Gas Journal, Oct. 3, 1983, pp. 87–91, "Stickiness Factor: A New Way of Looking at Stuck Pipe".

P. S. Keller, et al., Offshore Technology Conference, 1984, OCT Paper 4792, pp. 145–148 and 12 figures; "Economic and Statistical Analysis of Time Limitations for Spotting Fluids and Fishing Operations".

W. B. Hempkins, et al., SPE Drilling Engineering, vol. 2, No. 3, Sep. 1987; "Multivariate Statistical Analysis of Stuck Drillpipe Situations".

W. Brent Hempkins, SPE Paper 7144, 1978, "Multivariate Statistical Analysis in Formation Evaluation".

K. K. Milheim, SPE Drilling Engineering, vol. 2, No. 3, Sep. 1987, pp. 178–181 & 188–190, "Executive Summary".

W. R. Dillon and M. Goldstein, "Multivariate Analysis Methods and Applications", Chapter 10 "Discriminant Analysis; The Two Group Problem", pp. 360–374 and Chapter 11, "Multiple Discriminant Analysis and Related Topics", pp. 394–409, John Wiley and Sons ©, 1984.

*Primary Examiner*—Hoang C. Dang

[57] ABSTRACT

A method of avoiding stuck drilling equipment during drilling of a well over depth intervals where such equipment has stuck in similar wells in a geological province. A multiplicity of well drilling variable quantities are measured substantially simultaneously at a known depth in each of a multiplicity of wells. Such multiplicity of wells includes those in which drilling equipment has stuck due to mechanical problems or differential pressure between the drill string and an earth formation penetrated by the well bore, or both, and a multiplicity of similar wells where the drill string did not stick. By multivariate statistical analysis of all variables in all wells of each class, together with maximum separation of said classes from each other, a plotting plane for a currently drilling well relative to said classes is established. The location of the relative position of all variables in such a drilling well with respect to the well classes is determined by summing the products of the coefficient of each variable for the complete group of wells times the current value of the variables in the drilling well. The variables are then modified within allowable values to change the plotted location of the drilling well toward the mean of the wells that did not stick the drill string.

17 Claims, 9 Drawing Sheets

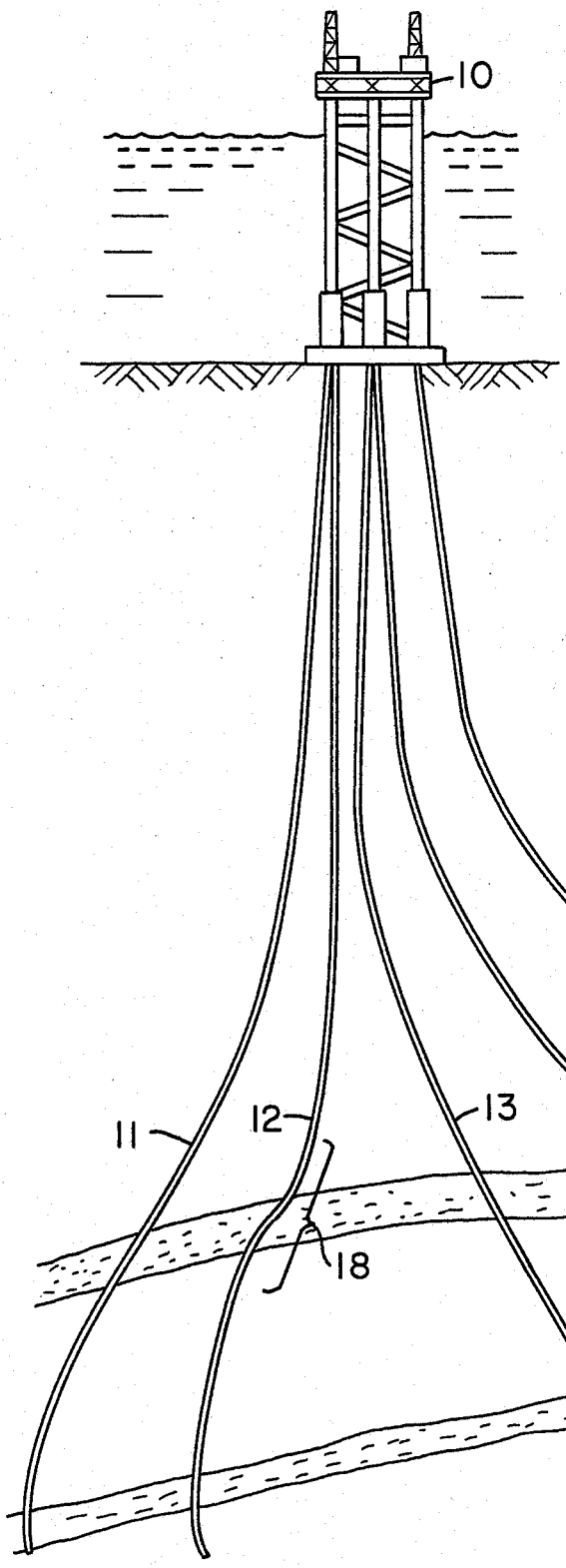
FIG. 1.
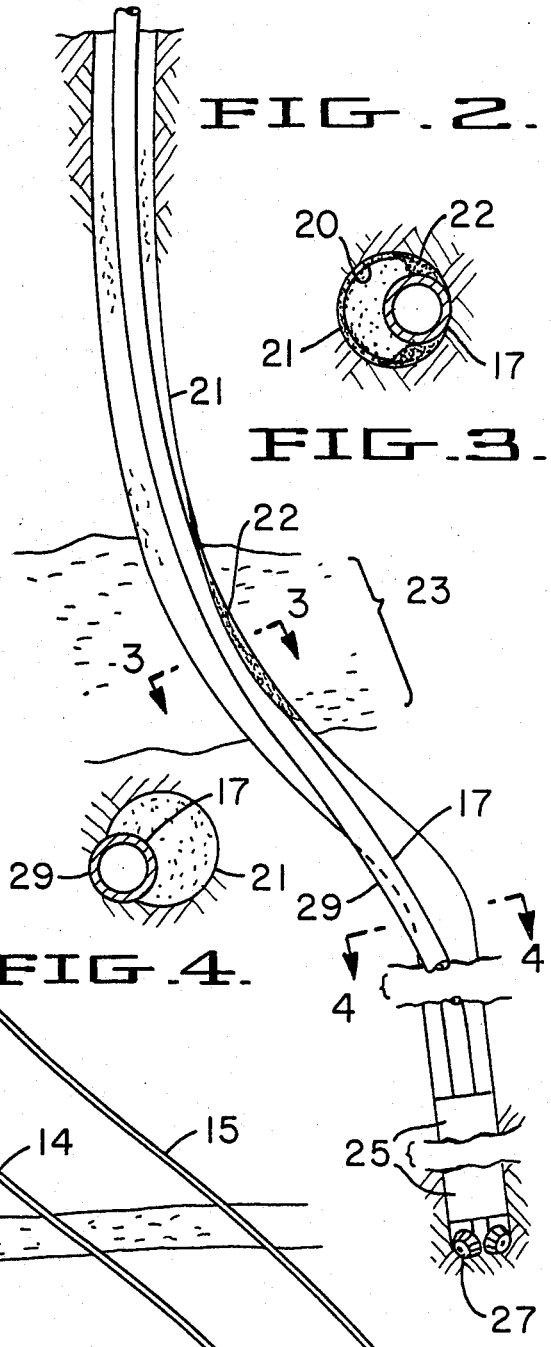
FIG. 2.
FIG. 3.
FIG. 4.

METHOD OF AVOIDING STUCK DRILLING EQUIPMENT

This is a continuation-in-part of application Ser. No. 756,307, filed July 15, 1985 now abandoned.

The present invention relates to a method of determining the probability of drill pipe sticking during drilling of a well in a given geologic province where such drill pipe is known to stick. More specifically, it relates to a method of controlling or modifying drilling conditions in such a well to avoid sticking of the drill pipe either due to mechanical conditions of the drill string and in the well bore, such as high hole angle, oversize drill collars and the like, or due to differential sticking, as a result of excessive differential hydrostatic pressure on the drill pipe against a low-pressure earth formation surrounding the well bore.

It is a particular object of the present invention to control drilling of a well by statistically calculating or plotting, or both, the probability of a drill pipe sticking in a well bore and correcting well drilling conditions to avoid that result. Such probability is calculated from a multiplicity of independent and dependent variables or physical quantities which represent standard mechanical, chemical and hydraulic drilling conditions normally measured in drilling the well. The same physical quantities in a multiplicity of wells are measured at depths where a drill string has become stuck mechanically or differentially, or at corresponding depths in a multiplicity of similar wells where the drill string has not stuck. The statistical probability is then calculated by a method of statistical analysis known as "multivariate analysis" from such similarly measured quantities at any one depth in any of such multiplicity of wells in a given geologic province where drill pipe sticking has occurred. "Geological province", as used herein, includes a geographical area of a sedimentary basin in which a multiplicity of wells have been drilled and wherein similar consequences of earth formations, such as shale-sand bodies of differing compositions are normally encountered over a range of known well depths. From such measurements in wells where drill pipe has become stuck in a significant number of instances, due to both mechanical and differential pressure conditions in the well bore, and in a similarly significant number of instances wells were drilled without such pipe sticking, the probability of avoiding sticking the drill pipe during drilling, whether due to mechanical or differential pressure, or both, is increased by progressively controlling such measured quantities relating to drilling conditions.

Monitoring and correcting the variable mechanical and hydraulic quantities of the three classes of such data measured during drilling, in accordance with the invention, is accomplished by a statistical method known as multivariate analysis. Such analysis depends upon matrix algebra to generate vectors for each well to represent conditions in all wells in each class over the given depth range. Each such algebraic value is then graphically plotted as the intersection of the corresponding well vectors within a two-dimensional plane which is selected to best separate the three classes of wells. The statistical probability of such multiplicity of related and unrelated (but measured and measurable) variables then permits generation of a similar vector for current drilling conditions in a given well to determine the relative position of such well with respect to each of the three classes. Control of drilling in an individual well is then modified by changing variables, such as drilling mud properties, hole angle, drill string composition, etc., dependent upon their positive or negative effects on the plotted location of the well vector relative to the three spatial areas representative of the respective three classes of wells.

BACKGROUND OF THE INVENTION

Drilling deep wells, say over 9,000 ft. with water-based drilling fluids and without setting well casing to prevent drill pipe sticking, is a long-standing problem. Particularly in off-shore drilling, numerous deep wells are usually drilled from a single stationary platform with a work area generally less than ¼ acre. Thus, the wells must be directionally drilled ("whip-stocked" or "jet deflected") at relatively high angles from vertical to reach substantial distances away from the single platform. In this way petroleum may be produced from formations covering substantial underground areas including multiple producing intervals.

In general, it is most economical to drill such wells using a water-based drilling fluid which lubricates and flushes rotary drill bit cuttings from the bore hole, but more particularly, provides hydrostatic pressure or head in the well bore to control pressures that may be encountered in a petroleum-containing formation. Such hydrostatic head prevents "blow-out" or loss of gas or oil into the well during drilling. Further, the drilling fluid contains solid materials that form a thin mud cake on the wall of the well bore to seal any permeable formation traversed by the well during deeper drilling. Such water-based drilling fluids, including sea water, are substantially cheaper than the alternative oil-based fluids from the standpoint of original cost, maintenance and protecting the ocean environment.

It has long been known that one of the primary causes of drill string "sticking" is the effect of differential pressure between the hydrostatic head in the well bore and any porous, low-pressure earth formations through which the drill string passes. Under such conditions, the pressure difference presses the drill pipe against the bore hole wall with sufficient force to prevent pipe movement. This occurs because the density or weight of the drilling fluid in the well bore creates a hydrostatic pressure against the pipe that is substantially greater than that in a porous earth formation traversed by the well bore. This is due to the filtrate (water in the drilling fluid) flowing through the well bore wall and the desirable "mud cake" into the low pressure earth formation. This condition may occur in the drill collar section of the drill string which is used to apply weight to the bit directly above the drill bit, but apparently more frequently, occurs at shallower depths where return mud flow around the smaller diameter drill string is less turbulent and hence relatively laminar. Thus, where the drill pipe lies close to one side of the well bore, as in slant holes, higher differential pressure across the drill pipe increases its adherence to the side of the well bore. In a worst case, this results in differential pressure sticking of the drill string.

Correction of drill string sticking conditions usually requires a decrease in the drilling fluid pressure in the well either by reducing the hydrostatic head of the drilling fluid or increasing solids content of the fluid to reduce filtrate loss, with subsequent building of a thicker filter cake to increase the pipe contact area. Alternatively, sticking can sometimes be avoided by using smaller diameter drill pipe or fewer drill collars in the weight assembly above the bit. The problem of differential pipe sticking is frequently severe where a well encounters over-pressured formations. In such wells, the formation pressure exceeds the pressure normally expected due to hydrostatic head alone at that depth. In such wells passing through over-pressured formations, the counterbalancing hydrostatic pressure in the well cannot be reduced safely at deeper depths. However, such increased pressures on deeper formations may substantially increase the risk of fracturing the formation, with accompanying loss of drilling fluid from the well into the fracture, and creating potential well blow-out.

It is also known that frequently a drill string may stick in a drilling well because of mechanical problems between the drill string and the well bore itself. Such a condition can sometimes occur in what is known as the "keyseat effect". That is, a keyseat is created when the drill string collar or a pipe joint erodes a circular slot the size of the drill pipe tube or tool joint outside diameter in one side of the larger circular bore hole, as originally cut by the drill bit. Such a slot can create greatly increased friction or drag between the drill string and the earth formation and result in seizure of the drill collars when an attempt is made to pull the string out of the hole and the collars become wedged in the keyseat. Such problems can also be created by excessive weight on the drill string so that the drill string buckles in the lower section and particularly where the bore hole is at a high angle, say in excess of 60° from vertical, or the well bore includes more than one change of direction, such as an S-curve or forms one or more "dog-legs" between the drilling platform and the drill bit. It is also known that in mechanical sticking of a drill string, earth formations around the well may be sufficiently unstable so that the side wall collapses into the well bore and thereby sticks the pipe.

It is estimated that the cost to the petroleum industry for stuck drill pipe in drilling wells is on the order of one-hundred to five-hundred million dollars per year and the cost to rectify each occurrence can be on the order of $500,000. The extent of each pipe sticking problem generally depends upon the amount of time the operator is willing to "wash over" the stuck section of the drill pipe (after unthreading and removal of the unstuck portion), or to "fish" by otherwise manipulating the drill string. Correction may also include spotting or completely replacing the water-based drilling fluid with oil-based drilling fluid. Failure to free the drill string results either in abandoning the well bore or side tracking the bore hole above the stuck point. This may include loss of the drill bit, collars and stuck lengths of pipe in the bore hole.

The problem of sticking pipe has been described in numerous publications in the literature, particularly as it relates to differential sticking of the well bore, that is, adherence of the drill string against a porous formation so that there is no circulation of drilling fluid around one side of the drill string. As noted above, such sticking occurs generally where the drilling fluid contains too few solids or fluid loss control agents allowing increase in the thickness of the mud, or filter cake, between the drill string and the side of the well bore due to liquid loss from the drilling fluid into a porous formation. Such literature is primarily directed to methods to avoid differential sticking by assuring that the drilling fluid is tailored to match the earth formations penetrated by the well bore.

In drilling deep wells, where intimate knowledge of the formations is not available, and particularly where low pressure formations are encountered, it is difficult to predict and take corrective or preventive action prior to such drill pipe sticking. Further, while these problems can be avoided by deeper casing of the bore hole around the drill string, such casing is expensive and in general undesirable because it limits formation evaluation with conventional well logging tools. Expense is also a primary reason that oil-based drilling fluid is not desirable, unless essential to the drilling operation. Many formation evaluation or well logging tools depend upon the use of water-based drilling fluids because such fluids are electrically conductive through the earth formation, rather than insulative, as in the case of oil-based drilling fluids. Since the cost of preventive action can be exorbitant as compared to conventional drilling systems, it is highly desirable, if at all possible, to drill with conventional water-based drilling fluids while still avoiding drill pipe sticking.

Examples of patents that disclose methods and apparatus to avoid or remedy stuck pipe include the following:

U.S. Pat. No. 4,428,441—Delinger proposes the use of non-circular or square tool joints or drill collars, particularly in the drill string directly above the drill bit. Such shape assures that circulation is maintained around the drill pipe and reduces the sealing area between the pipe and the side wall where the differential pressure may act. However, such tools are expensive and not commonly available. Further, they may tend to aggravate the keyseat problem in relatively soft formations since the square edges of such collars may tend to cut the side wall in high angle holes.

U.S. Pat. No. 4,298,078—Lawrence proposes using a special drill section directly above the drill bit to permit jarring the drill bit if the pipe tends to stick. Additionally, valves in the tool may be actuated to release drilling fluid around the drill string to assist in preventing or relieving stuck drill string condition.

U.S. Pat. No. 4,427,080—Steiger is directed to binding a porous layer on the outside of the drill string. Such a coating is stated to prevent differential pressure sticking of the pipe by increasing liquid flow around the drill string.

U.S. Pat. No. 4,423,791—Moses discloses avoiding differential sticking by use of glass beads in the drilling fluid to inhibit formation of a seal by the filter cake between the drill string and the well bore adjacent a low pressure zone.

While it has been proposed heretofore to statistically study the probability of relieving differential sticking of a drill pipe, such statistical analysis has been directed to the problem of estimating minimum soaking time and maximum fishing time that may be economically devoted to unsticking the stuck drill pipe. Such a procedure is disclosed in an article published at the Offshore Technology Conference of 1984 entitled "Economic and Statistical Analysis of Time Limitation for Spotting Fluid in Fishing Operations" by P. S. Keller et al. "Stickiness Factor—A New Way of Looking at Stuck Pipe", IADC/SPE paper 11383, 1983 Drilling Conference, pages 225–231 by T. E. Love is directed to a statistical study of "stickiness factor" for evaluating the probability of freeing stuck pipe by use of an empirical formula that evaluates several significant variables in drilling a well, namely, the length of open hole, mud weight, drilling fluid loss, and length of the bottom hole assembly. The formula was developed from wells in which drill pipe had become stuck and those in which drill pipe had not stuck by cross-correlation of 14 primary parameters measured in connection with drilling wells in a given area of the Gulf of Mexico. The primary purpose of the formula is to determine the chance of freeing stuck pipe and in guiding the well by controlling only the chosen variables used in the empirical formula. No suggestion is made to use statistical analysis of such differentially stuck walls along with mechanically stuck wells or to determine the probabilities of modifying only certain measured well variables to divert well drilling conditions from either of such stuck well conditions to a non-stuck condition.

Studies have also been reported by M. Stewart (Speech to Society of Petroleum Engineers, New Orleans Chapter, New Orleans, La., 1984) on the problem of setting casing at particular depths with statistical studies of differentially stuck pipe, particularly in the Gulf Coast, in wells that encounter over-pressure formations to avoid inadequate bore hole hydrostatic head on such formations or fracturing of lower pressure formations, as discussed above.

BRIEF SUMMARY OF THE INVENTION

The present invention is particularly directed to a method of evaluating the probability of correctly classifying the current or expected status of a well being drilled, or to be drilled in a known geologic province (as discussed above) without precise knowledge of the formations to be encountered, and then, controlling any selected one or more of a multiplicity of variable conditions or quantities that measure drilling fluid physical and chemical properties, drill string configuration, bore hole physical dimensions and earth formations traversed by the well bore. In accordance with the present method, such calculated probabilities are then used to correct drilling conditions to avoid sticking the drill string. However, if the drill string becomes stuck, the probability of the sticking cause may be determined and relief of the drill string directed by eliminating such cause rather than by exclusively assuming that the drill string is differentially stuck, as in the prior art.

In accordance with the present invention, statistical analysis of the probability of drill string sticking in a well bore is predicted not only due to differential pressure problems, as primarily addressed by prior workers in the field, but also due to mechanical or physical sticking substantially unrelated to differential pressure. Such conditions have been found to be equally important in avoiding drill string sticking. In particular, by statistical analysis of these types of wells, namely those in which differential pressure and mechanical sticking have occurred as well as those wells that were drilled and the drill string did not stick, the present invention makes possible significant improvement in directing future well drilling.

For such statistical control of drilling, and where an adequate number of all three types of wells have been encountered, a data base is formed from a multiplicity of measurements of each well and drill string parameters at a given level in a drilling well, and in a multiplicity of wells over a given geologic province. These three classes include wells in which the drill string has become stuck (1) mechanically, or (2) differentially or (3) the well has drilled through the depth interval of wells in classes (1) or (2) without becoming stuck. In a preferred form, such a probability map is created by plotting or recording a vector representing the solution of a data matrix for each well. Such data matrix is formed from each of the three groups of wells in which each measured variable is an element, $x_{ij}$, of an array (column or row) in one of the three matrices. The size or order of each such matrix is equal to the selected number of variables m recorded in each matrix. The size or order of the complementary column or row of each matrix is the number N of wells included in that matrix class. From each such matrix, the standard mean deviation matrix of each such variable relative to the same variable in all other wells of its class, is developed. From these matrices, the Pearson-product-moment correlation coefficient matrix for each class of wells may be developed wherein all coefficient values lie between $-1$ and $+1$. Then, by a procedure known as multivariate discriminant analysis, the latent roots or the eigenvalues and eigenvectors of these correlation coefficients for each matrix are resolved. Such analysis resolves these vectors into three substantially distinct groups that are spatially separable for graphic display but represent all wells sampled in a given geological province.

In a preferred method of carrying out the invention, such multivariate discriminant analysis of the data matrices includes finding a mathematical plane which optimally separates two of the three groups. The third group is separated by another plane which intersects the other separating plane. Thus, two planes separate the three groups. Each vector representing the complete suite of the multiplicity of measurements in a single well, is then projected onto one of the two planes so that each well vector appears as a point whose coordinates on the plotting plane are related to the three vector spaces. From these points the intergroup distances from the centroids of each group may be calculated and the grand centroid of all such values determined, mapped or plotted in the plotting plane. Based upon the calculated probability of each well being correctly classified as to its proper group, the probabilities of correctness may then be contoured. Where the probabilities are nearly equal that a well belongs to either of two groups the vector intersection point will normally fall near the intersection of the planes. Accordingly, the further the vector point is removed from such an intersection, the greater the probability that the well is correctly classified.

From the probability "map" it is then possible to plot the progress of a drilling well based on the same measured multiplicity of variables. The coordinates on the "map" are established by calculating the coefficient values of each variable element and summing such values to locate the intersection of the well data vector on the map plane at its current drilling depth. Control of selected ones of the measured variables then modifies well drilling conditions to move the coordinates of the probability well vector projection toward or beyond the "never stuck" probability centroid.

For example, where the multiplicity of measured variables generate a well vector which correlates current well drilling with mechanical sticking of the drill string, such conditions heavily depend upon angle of the bore hole to vertical, bore hole diameter, size of drill collars, and total depth of the bore hole, as well as frictional forces (drag) and torque on the drill string, but they also relate to drilling fluid hydraulic and chemical properties. Where such vector projection lies in vector space that primarily corresponds to high probability of differentially sticking the drill pipe, such vector heavily depends upon drilling fluid characteristics, such as density (weight per gallon), viscosity, gel strength, water loss, and flow rate; but it may also relate to depth and angle of deflection of the bore hole. Other measured drill system variables that may cause either differential sticking or mechanical problems, or both, are also desirably evaluated by the present method, such as true vertical depth, drill fluid pH, and drilling gas. In each instance of course such measured variables are adjusted only within the allowable range of their usable values.

Because the multiple measured parameters in each well adequately and clearly delineate the probability that during drilling of any well within the sampled depth interval will fall into the correct one of these three categories, any well to be drilled, or being drilled, may be controlled to "steer" its drilling conditions away from either sticking hazard and toward the probability of not sticking the drill string.

Each well in the preferred method of carrying out the invention generates a characteristic well vector composed of the relative contribution of each of the measured multiple variables which may be projected from multidimensional space as a single valued quantity and plotted by two coordinates on the selected two-dimensional mapping space. Its position is then represented in relation to the multiplicity of wells in each of the three groups or classes of wells. Thus each well, during drilling at any given depth, may be similarly evaluated by its vector projection onto the same mapping space. The two coordinates of the vector projection onto the map are desirably the sum of the products of each of the same multiplicity of variables multiplied by the coefficients corresponding to the same variables for all wells on the map. Corrective action then is taken to assure that the well vector is directed away from the high probability area for differential sticking, or mechanical sticking, or both, toward a "safe" value within the plot area where wells have a high probability of not sticking.

In accordance with the most preferred form of the method for carrying out the invention, a multiplicity of well variables are measured at a selected depth in each of the individual wells in a geological province to establish a data base. In the case of wells either differentially or mechanically stuck, the depth at which the drill pipe actually stuck is selected as the preferred depth. For non-stuck wells, one depth within the range of the stuck wells is selected. Such data base is then arranged in the form of three separate matrices corresponding to each of the three classes of wells. In each matrix each element of a row (or column) corresponds to a measured variable at the selected depth in one well. The standard mean deviation of each data element in each well is then calculated to generate a standard normal variate matrix for each of the three classes of wells. From the standard normal variate matrix a Pearson product-moment correlation coefficient matrix is produced by cross multiplication of the corresponding measured variables and addition of the cross products for all possible pairs of wells in each matrix. A multiplicity of such well vectors from the multiplicity of wells are formed into a probability matrix of the same size which is applicable to the entire geological province. The elements in such a matrix thus include those from wells that are (1) known to have stuck by differential pressure, (2) known to have stuck because of mechanical problems and (3) wells where the drill string did not stick. The three groups are then separated by a technique known in statistics as "multivariate discriminant analysis" of such matrices; in such technique, the three groups are separated by a pair intersecting mathematical planes. Each well vector from multidimensional space is then resolved to a pair of coefficients representable as a point on a mapping surface projected onto the two planes. This permits vector projections from multidimensional space to be separated to the maximum extent and the vector intersections with the plotting plane plotted in two dimensions. By contouring the probability of each well as represented by its vector coefficients onto the mapping surface, it is thereby possible to separate wells that became differentially stuck from those in which the drill string became mechanically stuck, and both are separated from the "never stuck" drill string vectors. Then, from individual measurements of the same variables at any level in a well bore while it is being drilled, the coefficients for each such variable are used to calculate the sum of the vector coefficients multiplied by the current variable values. These sums yield the vector coordinates of the well being controlled on the mapping plane and permit display of the probability of the present position of the drilling well vector with respect to the three groups. From such calculated position, the controllable variables such as mud weight, solids, drill collar size, etc., in the drilling well may be correctly evaluated and modified to move the probability of the drilling well toward the coordinates of the map that represent a desired high probability that the well is in the "not stuck" region. Such a procedure makes possible analysis and directional control of the drilling well to avoid problems of either mechanically or differentially sticking the drill pipe in a drilling well.

Further objects and advantages of the present invention will become apparent from the following detailed description of the accompanying drawings and the description of the preferred embodiments of the present invention.

BRIEF DESCRIPTION OF THE DRAWINGS

FIG. 1 is a perspective cross-sectional elevation view representing a plurality of wells drilled from a single off-shore platform and indicates several types of deep, highly deflected, wells to which the well drilling method of the present invention is particularly applicable to improve the probability of avoiding sticking the drill pipe in the well bore either due to differential pressure or mechanical problems.

FIG. 2 is a perspective elevation view of a portion of a well bore illustrating one type of problem involved in mechanically sticking a drill string, namely, a small diameter keyseat formed by the drill in the side of the well bore.

FIG. 3 is a perspective elevation view of a portion of a well bore illustrating a drill string sticking against a low pressure formation due to different pressure.

FIG. 4 is a cross-sectional view through the drill string and well bore in the direction of the arrows 4—4 in FIG. 2, indicating a drill pipe in a keyseat.

DETAILED DESCRIPTION OF THE PREFERRED EMBODIMENTS OF THE PRESENT INVENTION

Figure 5:
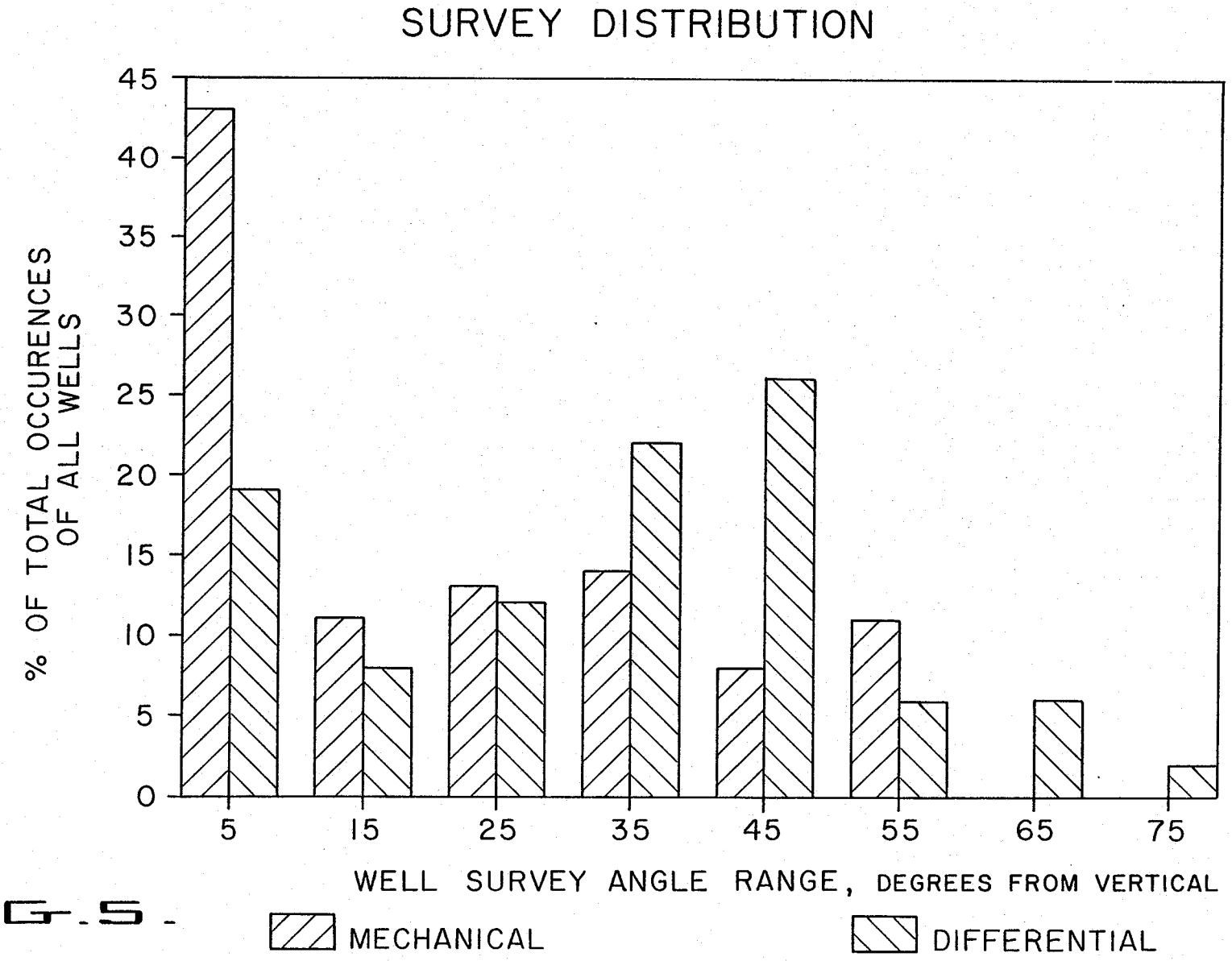
FIG. 5 is a bar graph of survey angles of well deviations from vertical in a significant number of wells drilled in a given geological province which became stuck to mechanical or differential pressure problems.

FIG. 1 indicates in elevation and partially in perspective, a fixed off-shore drilling platform 10 of the type normally used to develop a major portion of one or more underwater producing formations. The well drilling control system of the present invention is particularly applicable to such drilling because a plurality, say 10 to 30 wells such as 11, 12, 13, and 14 and 15 are drilled from single platform 10 at high deflection angles to vertical to develop an underwater petroleum reservoir 16 extending over several thousand feet laterally from the platform. As indicated, the wells 11 to 15 are selectively drilled at differing angles and may include one or more "dog legs" 17 (different angles to vertical). They may even take S-curve configurations, as in well 14, in drilling to a desired depth. Such configurations may either be planned because of geological conditions or occur inadvertently during drilling.

It has long been known that high angle wells have a tendency to stick the drill pipe. This is particularly true at depths in excess of 12,000 feet. It has generally been assumed that such sticking is due to differential pressures between the well bore and an earth formation acting on the drill pipe; such differential pressure being due to higher pressure in the well bore than in a formation traversed by the well bore. In some geological provinces, including offshore wells in the Gulf of Mexico, high pressures are frequently encountered at relatively shallow depths; that is, the pressure in such a formation exceeds the normal vertical gradient of hydrostatic or geostatic head expected at that depth. (Normal well pressure is essentially the pressure of water in a well bore at a given depth.) To control over-pressured formations, the well pressure, as applied by the density of the drilling fluid, or mud, in the hole, must exceed pressure in the formation. However, at greater depths in the well, formation pressures may be nearer to normal for such depth. Accordingly, to maintain adequate well pressure opposite the upper high-pressure formation, hydrostatic pressure on the lower formations may be excessive. Such excessive well pressure may fracture the formation, with resulting loss of drilling fluid to the formation and consequent blow-out danger.

In drilling wells with excessive bore hole pressure through lower pressure, permeable formations using water-based drilling fluid, water may flow into the formation. Such flow is through the well bore mud or filter cake 20 around well bore 21, which normally is a thin layer of gelled solids that seal off the permeable formation 23. This flow may cause excessive precipitation of solids in the filter cake. The condition is indicated at 22 in FIGS. 2 and 3. Continuing flow of liquid into the formation increases the thickness of the filter cake and increases the contact area of the drill pipe 17 so that the drill pipe seals or sticks against the wall of well bore 17. An increase in the filter cake thickness additionally tends to make restoring drilling fluid circulation between the drill pipe and the well bore difficult. Further, the thixotropic drilling fluid returning to the surface from the drill bit and flowing over the remaining area of the bore hole 21 may become relatively laminar so that the fluid tends to set up or gel. As is well known in the drilling art, the precise cause of such differential sticking is frequently difficult to determine. Hence, correcting such a condition is, in general, by trial and error.

Further, the prospect for correcting a stuck condition may determine how much non-drilling rig time the operator can afford to use in "fishing", as opposed to the cost of abandoning that portion of the well bore. Such abandonment frequently requires sidetracking the hole above the last pipe section that is not stuck. This requires explosively cutting or unthreading the drill pipe above the stuck point. plug is then set in the bore hole with loss of equipment including drill collars and bits. The well is then redrilled to the same depth, and deeper if possible. Accordingly, knowing the probability of avoiding sticking or unsticking a differentially stuck drill string, as well as knowing the probability that the drill string is mechanically stuck, rather than differentially stuck are of high economic value. This is particularly true where rig cost is on the order of thousands of dollars per hour, as in offshore drilling.

FIGS. 2 and 4 illustrate a portion of a drill pipe 17 above the drill collars 25 and drill bit 27. As shown, substantially all of the drill pipe 17 is smaller in diameter than bore hole 21, as originally cut by drill bit 27. Generally, the drill pipe proper is more flexible than the bottom hole assembly, including drill collars 25 and drill bit 27. Accordingly at high angles, the drill pipe may tend to sag against one side of the well bore wall. The drill string in such a condition may mechanically cut the side of the well bore as at 29 in FIGS. 2 and 4 to form what is known as a "keyseat". Under such conditions, the diameter of drill pipe 17, or joints between pipe sections are smaller than the drill collar sections or drill bit. When the pipe is then moved up or down (as in a "round trip" of the drill string to change bits), the pipe or joints may cause the pipe to mechanically stick in the bore hole.

Other mechanical problems may result from formation collapse of low pressure formations into the well bore. While it has been known that a drill string may become suck both by differential pressure conditions and mechanical problems, it has been commonly assumed that the greatest danger is in differential sticking and prior practice has generally been to assume that any stuck well is differentially stuck.

We have found from our statistical study of numerous cases of pipe sticking that such an assumption is not necessarily true. As a result, methods of attempting to unstick the pipe may not be specific to the most likely or probable cause of either mechanical, or differential sticking, or both. Accordingly, a method of determining the probability of how a drill pipe has been or may become stuck and how to avoid such sticking in a drilling well is a long felt need in well drilling.

Our study included well drilling variables measured in several hundred wells, some of which were known to have stuck due to differential pressure. Others were known, or suspected, to have stuck due to mechanical problems. However, in the same geological province a significant number of wells were drilled where the drill string did not stick. All were drilled over a significant geological area in the Gulf of Mexico. In general the wells sampled in such geological province involved wells drilled deeper than 9,000 feet in a basin having generally similar common geological structure. Such wells were drilled through sand and shale strata forming traps for petroleum reservoirs, such as those around salt domes or terminated by faults.

Figure 6:
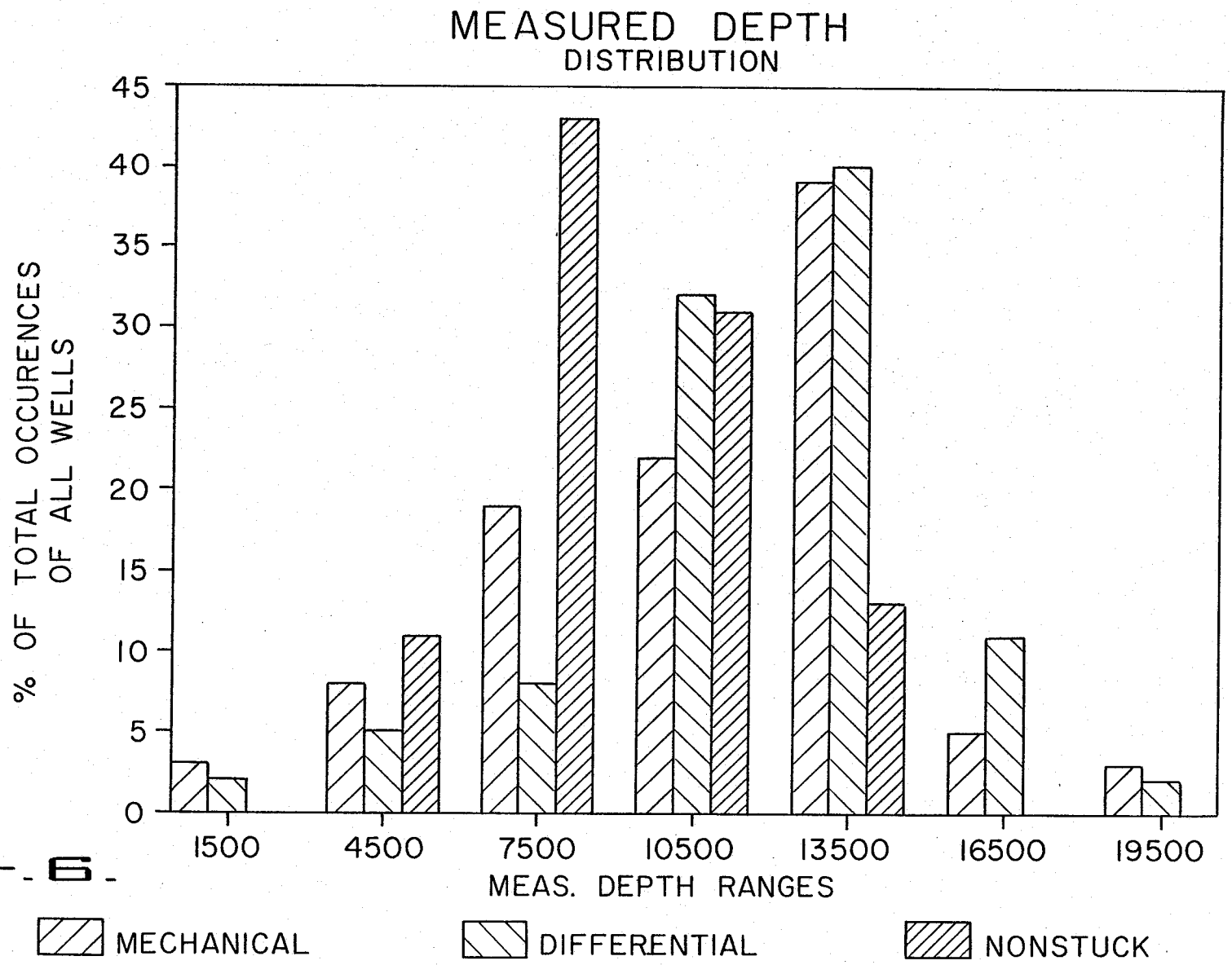
FIG. 6 is bar graph of measured depth ranges of wells in the sample of FIG. 5 plotted against the percent of total occurrences of sticking, as between mechanical and differential pressure, and those that did not stick.
Figure 7:
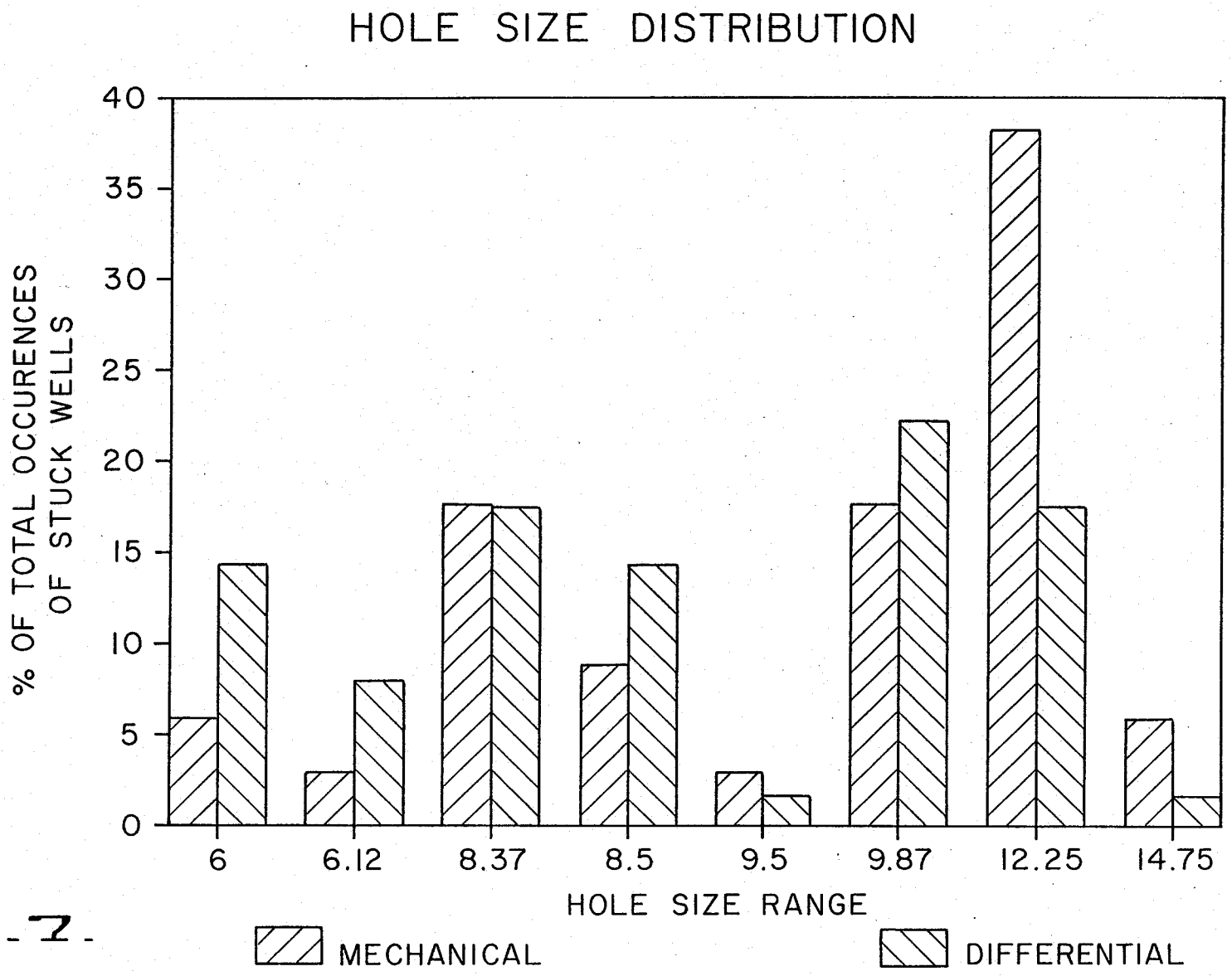
FIG. 7 is a bar graph similar to FIGS. 5 and 6 show hole-size range plotted against percent of total of mechanical and differential pressure sticking.

As will be explained more fully below, the drilling variables in each well were measured. On the order of 20 were used. Several dozen such measured and measurable quantities were recorded at a selected depth in each well in a multiplicity of wells in each of these three classes. The relative number of wells in each of the three classes is indicated in FIGS. 5, 6 and 7. FIG. 5 shows in bar graph form the percent of wells in the sampled number where pipe became stuck mechanically or differentially over a range of from 0° to 75° deviation from vertical. FIG. 6 indicates in bar graph form the distribution of the three classes of wells forming the data matrices plotted as a function of depths of the wells. FIG. 7 is a similar bar graph of the hole size range of wells in the sample.

Figure 8:
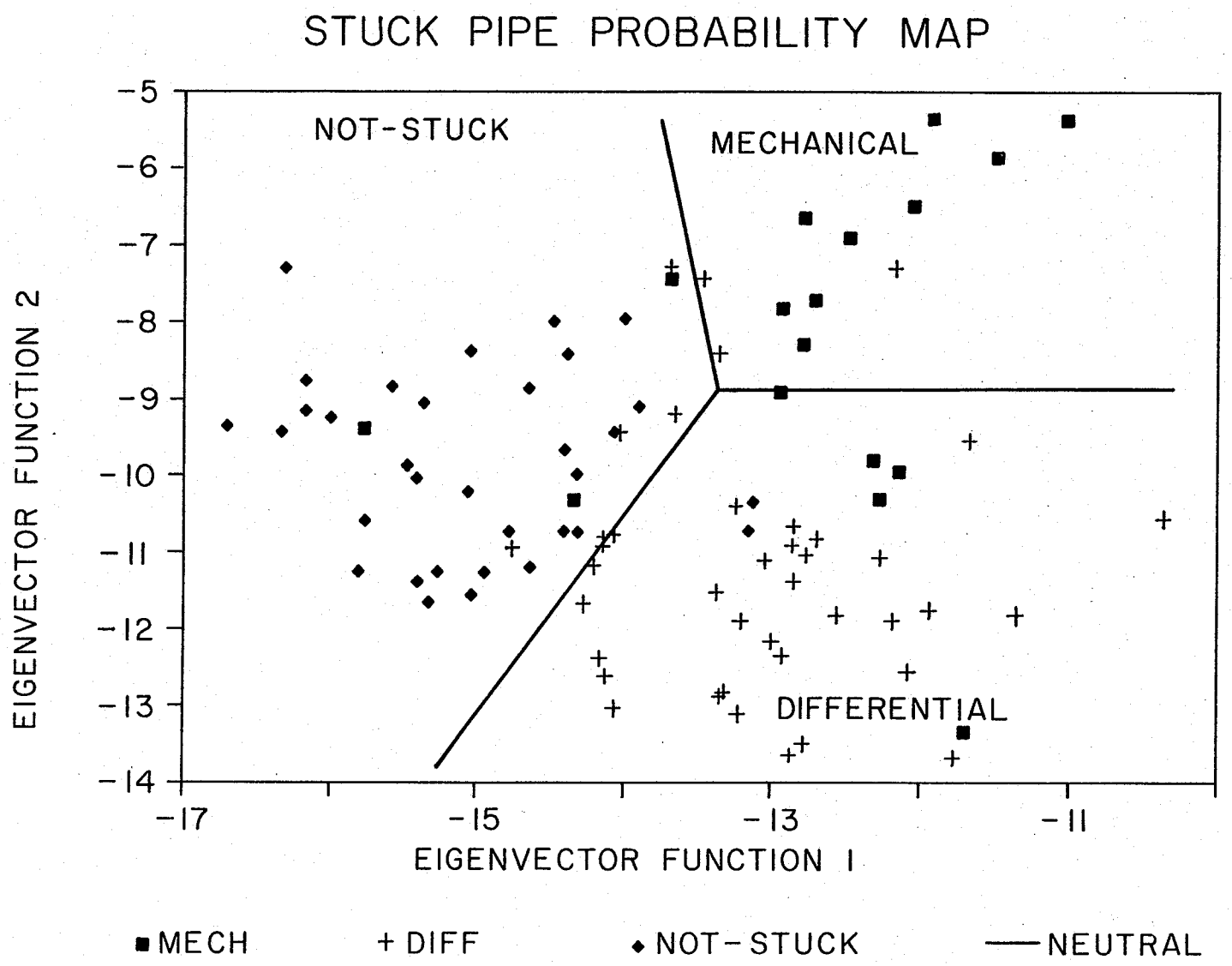
FIG. 8 is a stuck pipe probability "map" in which the vector of each well is plotted as a point intersection of its vector from multidimensional space with a two-dimensional surface. Such surface is a projection onto the two planes which separate the three spatial vector groups representing the three classes of wells, which were stuck (1) mechanically or (2) by differential pressure and (3) those that were not stuck.
Figure 9:
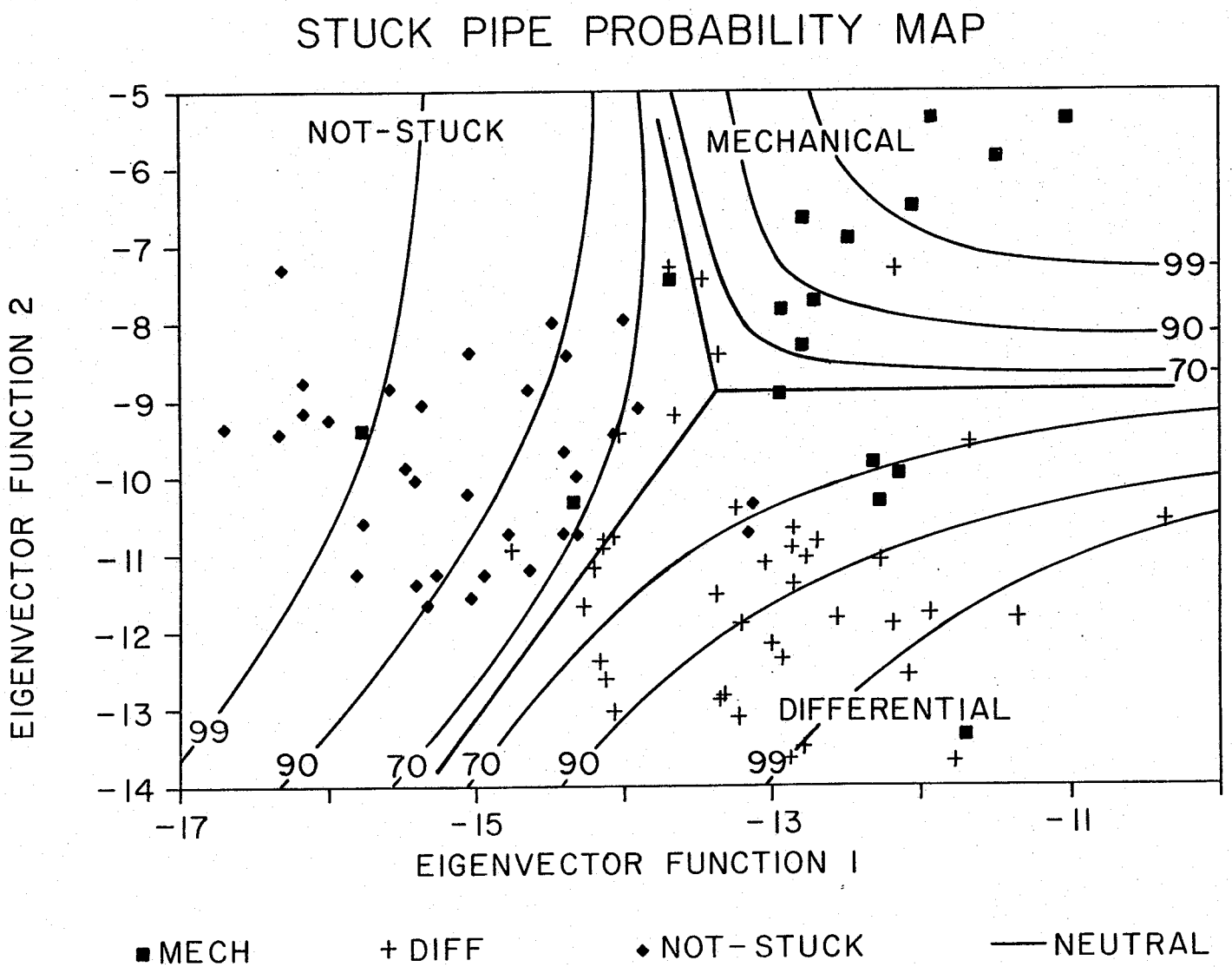
FIG. 9 is a stuck pipe probability map in which the probability of each well being correctly classified into its correct group is contoured.
Figure 10:
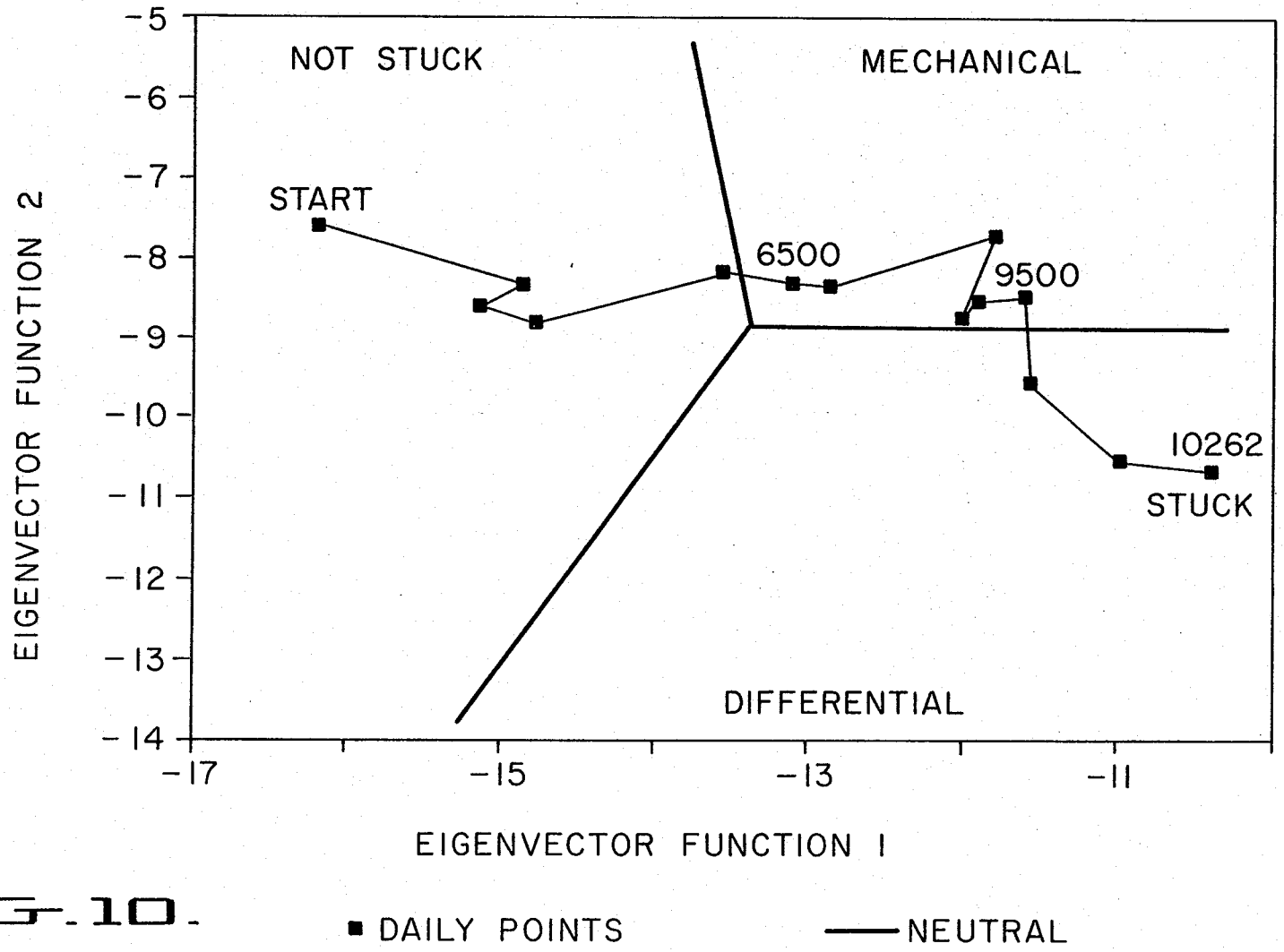
FIG. 10 is a plot of the progress of a single well, which was analyzed by the sampled variables at regular depth intervals, which became stuck differentially. The plot indicates the course of the well proceeded from a probability of being a non-stuck, through the probability of being either mechanically or differentially stuck, to a high probability condition that the drill string would, and in fact did, become differentially stuck.

FIGS. 8, 9 and 10 are probability plots of the vector projections on a single plane or map of each well in each of the three classes of wells. These plots or maps were developed by multivariate analyses of all measured variables in each of the three classes by the method of the present invention. These maps indicate that the three classes of wells can be readily distinguished with sufficiently high probability so that by measuring the same multiplicity of measured variables at any given depth, the drilling conditions in a single drilling well may be plotted to control the well while it is being drilled. Such control may be either by preplanning the drilling program or by implementing corrective action during drilling. Progress of such a well during drilling is plotted to show its progress, relative to the three conditions, on such a two-dimensional map in FIG. 10.

Development of plots on maps useful in such control, and as shown in FIGS. 8, 9, and 10, is by statistical analysis of probabilities using a method known as multivariate discriminant analysis. In a given geological province, a significant number of wells, each of the three types of wells, is used to form statistically reliable samples. A comparable data matrix is then developed for each group using the same multiple variables for each well in the assigned matrix. It will be apparent to those skilled in the art that similar probability maps can be developed for other geological provinces from such a multiplicity of significantly different measured drilling variables, selected in accordance with the desires of the well driller.

In FIG. 8, the separation of the three groups by two intersecting planes is indicated by the three lines intersecting at the center of the plot. These lines are the best separating boundaries, as determined by such planes.

FIG. 9 is similar to FIG. 8 and illustrates contour lines in each of the three groups indicating the probability that each well vector is correctly plotted within the assigned group. The well plotted in FIG. 10 is on the same vector coefficient map as the wells plotted in FIGS. 8 and 9.

Figure 11:
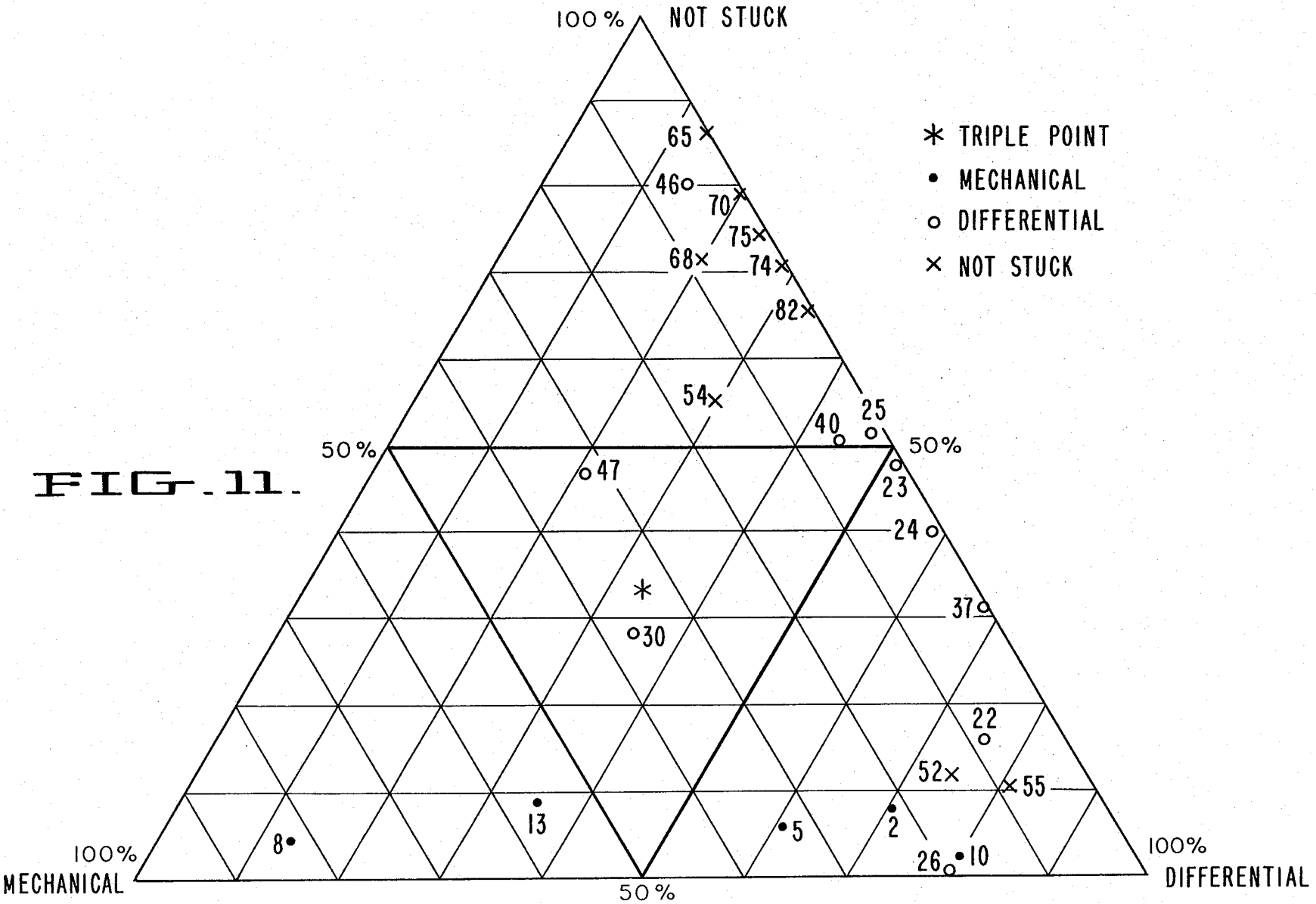
FIG. 11 is a triangular graph of well vectors shown in FIG. 9.

FIG. 11 illustrates in a triangular graph an alternative method of plotting the probability of the wells shown in FIG. 9 for each of the three classes of wells. As indicated, the nearer each well is to the apex of each class, the greater the probability that it is correctly classified for corrective action through modification of the contributing variables.

EXAMPLES

To illustrate development of the method of the present invention, a condensed outline of the specific steps including the mathematical basis are set forth. Such steps include the probabilities of sticking the drill pipe either mechanically or due to differential pressure and avoiding sticking while drilling a well bore with water-based drilling fluid. A simplified illustration of use of such steps to so control drilling are then given in a specific numerical example. The steps are as follows:

(a) Prior to drilling said well bore measuring in a multiplicity, m of related well drilling variables in a multiplicity, N, of wells drilled under comparable drilling condition in three different groups of wells, the measured variables being at a given depth in each well bore and the three groups being where a drill string has either (i) become mechanically stuck during drilling or (ii) become stuck by differential pressure between the well bore and a permeable earth formation traversed by said well bore, or (iii) has drilled through depth intervals of wells selected in (i) or (ii) without sticking;

(b) forming each of said three groups of N wells in step (a) into a separate matrix in which each of the measured variables m is an element of $x_{ji}$ in a common group array (row or column), and the complementary group array (row or column) is one of the N wells selected as a member of its respective group, as used in the following matrices and equations, j indexes any well in any group, i indexes any variable in any well; and N is the number of wells in each group (which need not necessarily be the same number in each group, but variables m are the same number and type in each group;

(c) in each of the groups forming a standard mean (average) Vector, $\overline{X}_i$, of each variable in a given group array to form a corresponding group Standard Mean Variance Vector, $S_i$:

wherein said Mean Vector $\overline{X}_i$ is $$\overline{X}_i = 1/N \sum_{j=1}^{N} X_{ji}$$

where j=1,2,3,—m (variables)
and i=1,2,3,—N (wells)

and said Variance Vector $S_i$ is:

$$S_i = 1/(N-1) \sum_{j=1}^{N} (X_{ji} - \overline{X}_i)^2$$

and the Standard Deviation Vector $s_i$ of each element of said group is:

$$s_i = \left( 1/(N-1) \sum_{j=1}^{N} (X_{ji} - \overline{X}_i)^2 \right)^{\frac{1}{2}}$$

$$\text{or } s_i = \sqrt{S_i}$$

(d) forming the Pearson Product-Moment Correlation $r_{ik}$ wherein the value between any two variables, say $x_{ji}$ and $x_{jk}$ is defined as the group Variance-Covariance Matrix, $C_{ik}$ $$C_{ik} = \frac{1}{N-1} \sum_{j=1}^{N} (X_{ji} - \overline{X}_i)(X_{jk} - \overline{X}_k)$$

$$j, k = 1,2,3 \ldots m$$

and the Within Group Correlation Matrix, $r_{ik} = C_{ik}/s_i s_k$ *to express the linear dependence or relationship, of said pair of x's, (say i=1,* k=2) and so that each of said coefficients $r_{ik}$ is expressed in a square, symmetrical group matrix R where the i's and k's refer to each variable in the total population, and the Within Group Correlation Matrices are similarly defined so that the j's refer only to the members of that Group and the $\overline{X}$'s and $s_i$'s refer only to the mean and standard deviations of that group, (e) then similarly forming a weighted average of the three Within Group Correlation Matrices (pooled matrices) $R_T$ in which said correlation matrices are symmetric, square and positive, semi-definite, (f) solving the matrix product, Q, of the inverse of the Within Group Correlations with the Between Group Correlations (Total Correlation Matrix minus Within Correlation Matrix) such that the relations are:

$$T = A + W$$

where

T=Total Correlation Matrix
A=Between Group Correlation Matrix
W=Pooled Within Group and $$Q = \frac{A}{-W} = W^{-1}A \text{ wherein } W^{-1} \text{ is the inverse of } W$$

wherein W−1 is the inverse of W and solving $$|(Q - \lambda_g I)| \nu_g = 0$$

wherein $\lambda_g$ are the eigenvalues (latent roots), $\nu_g$, are associated eigenvectors, I is the identify matrix, and g is the number of roots which exist, (g) multiplying each original measured variable element in the original matrix formed in step (b) by its corresponding eigenvector coefficient $\nu_g$ and scaled $\lambda_g$ and separately summing the products for each array of measured variables, (h) plotting the sums of said products with the values of $\nu_g$ and scaled by $\lambda_g$ for each array as a representation of the probability of each of the wells being correctly located in its assigned class; and (i) then multiplying and summing the products of and $\nu_g$ and $\lambda_g$ for each measured variable in another well whose probability of sticking is to be determined and which is drilled within said geological province and said depth range.

To illustrate use of the method of the present invention, a simplified example is calculated as follows. A total of m=4 (four) measured well variables in each of N, or n=3 (three) wells in each of the groups or classes of wells. It will be apparent that in actual practice the same procedure will apply to all measured variables, say 20 in all wells, say 40 to 1200 wells in each matrix.

Selection of the wells for identification in each of the three groups, as noted above, is made on the basis of one set of 20 variables, at a known depth in each well. This set, in the case of each stuck drill string, is preferably the last set of such variables; i.e., the depth at which the drill string became stuck mechanically and differentially. However, conditions measured in such well just before the drill string became stuck may also be used. A single set of 20 variables for each non-stuck well is selected at a randomly chosen depth within a typical range of depths of the differentially and mechanically stuck wells.

Each matrix X is then assembled with the m variables and n wells as follows:

FIRST OF 3 GROUPS OF 3 WELLS AND 4 VARIABLES

| | VARIABLES, m | | | |
|---|---|---|---|---|
| WELLS, N | i = 1 | i = 2 | i = 3 | i = 4 |
| j = 1 $x_{11}$ | 9750 | 13.7 | 4750 | 70.0 |
| j = 2 | 9500 | 14.5 | 5000 | 60.0 |
| j = 3 | 10000 | 13.1 | 4500 | $x_{ji}$ = 50.0 |

where the variable in columns i=1 to i=4 are i=1 is Total Depth (feet)
i=2 is Mud Weight (lbs/gal)
i=3 is Drill Weight on bottom (pounds)
i=4 is Hole Angle to Vertical (degrees)

In the example, the column mean $\overline{X}_i$ for each variable is determined as:

$$\overline{X}_i = 1/N \sum_{j=1}^{N} x_{ji};$$

where:

i=1,2,3 . . . m (=4 variables)
j=1,2 . . . N (=3 wells)
$\overline{X}_i = \frac{1}{3}(9750 + 9500 + 10000) = 9750$ Similarly for each of the other columns, the means are calculated as:

MEANS OF FIRST GROUP

| $\overline{X}_i$ = 1 | $\overline{X}_i$ = 2 | $\overline{X}_i$ = 3 | $\overline{X}_i$ = 4 |
|---|---|---|---|
| 9750.00000 | 13.7666626 | 4750.00000 | 60.0000000 |

The Variance Vector $s_i$ for each column is then calculated by subtracting the column mean from each element of each column, summing these values, and dividing by the number of variables minus 1.

In the above example the variance is constructed as follows:

For the first column of the data, the variance $s_i$ is calculated as:

$$s_i = \frac{1}{N-1}[(9750-9750)^2 + (9500-9750)^2 + (10000-9750)^2] = 62{,}500$$

(as used in the following tables, 62,500 is $0.625 \times 10^5$ and expressed as 0.625E+05).

The standard deviation is the square root of the variance which gives 250.00. This, as calculated by the computer is expressed as 249.927994 which is the same as 250.0 to the precision of the data. Similarly, this value and other standard deviations are:

| $s_i = 1$ | $s_i = 2$ | $s_i = 3$ | $s_i = 4$ |
|---|---|---|---|
| 249.927994 | 0.7024302 | 250.007996 | 10.0000000 |

In order to express any linear relationships between the variables, the VARIANACE/CONVARIANCE MATRIX is then calculated as $$C_{ik} = \frac{1}{N-1}\sum_{j=1}^{N}(x_{ji} - X_i)(x_{jk} - X_k)$$

where j refers to the wells and i,k represent the variables and run from 1 to 4. When i=k, the product is the variance.

The VARIANCE-COVARIANCE MATRIX is then:

Variables →

| | 1 | 2 | 3 | 4 |
|---|---|---|---|---|
| 1 | 0.625E+05 | −0.175E+03 | −0.625E+05 | −0.125E+04 |
| 2 | −0.175E+03 | 0.493E+00 | 0.175E+03 | 0.300E+01 |
| 3 | −0.625E+05 | 0.175E+03 | 0.625E+05 | 0.125E+04 |
| 4 | −0.125E+04 | 0.300E+01 | 0.125E+04 | 0.100E+03 |

When the diagonal entries are divided by the variance of that variable the value is identically unity. Off diagonal elements are divided by the product of the two standard deviations of the variables represented by that row-column intersection, i.e. row one intersection with column two is divided by the standard deviations of variable 1 and variable 2. This gives the correlation matrix, $r_{ik}$ or $R_1, = C_{ik}/s_i s_k$.

The CORRELATION MATRIX $R_1$ for the first group is then:

Variables →

| 1 | 2 | 3 | 4 |
|---|---|---|---|
| 0.100E+01 | −0.996E+00 | −0.100E+01 | −0.500E+00 |
| −0.996E+00 | 0.100E+01 | 0.997E+00 | 0.427E+00 |
| −0.100E+01 | 0.997E+00 | 0.100E+01 | 0.500E+00 |
| −0.500E+00 | 0.427E+00 | 0.500E+00 | 0.100E+01 |

This matrix is symmetrical about the diagonal, i.e. the intersection of row 1 with column 2 is the same as the intersection of row 2 with column 1. The correlation matrix has the special property that it is square and positive, semi definite (i.e. all its characteristic roots are non-negative). The other groups have the following statistics:

SECOND OF 3 GROUPS OF 3 WELLS AND 4 VARIABLES

ORIGINAL DATA
VARIABLES m = i
WELL N = j

| | i=1 | i=2 | i=3 | i=4 |
|---|---|---|---|---|
| j=1 | 5500.00000 | 10.80000 | 3700.00000 | 21.00000 |
| j=2 | 5000.00000 | 10.40000 | 3500.00000 | 25.00000 |
| j=3 | 6000.00000 | 11.20000 | 3250.00000 | 30.00000 |

Means of SECOND group are:

| $\bar{X}_i$= | $\bar{X}_i$=2 | $\bar{X}_i$=3 | $\bar{X}_i$=3 |
|---|---|---|---|
| 5500.00000 | 10.7999973 | 3483.33325 | 25.3333282 |

The Standard Deviation Vectors of this group are:

| $s_i$=1 | $s_i$=2 | $s_i$=3 | $s_i$=4 |
|---|---|---|---|
| 500.023926 | 0.4000427 | 225.459534 | 4.5092545 |

VARIANCE-COVARIANCE MATRIX, $C_{ik}$

Variables →

| | 1 | 2 | 3 | 4 |
|---|---|---|---|---|
| 1 | 0.250E+06 | 0.200E+03 | −0.625E+05 | 0.125E+04 |
| 2 | 0.200E+03 | 0.160E+00 | −0.500E+02 | 0.100E+01 |
| 3 | −0.625E+05 | −0.500E+02 | 0.508E+05 | −0.102E+04 |
| 4 | 0.125E+04 | 0.100E+01 | −0.102E+04 | 0.203E+02 |

CORRELATION MATRIX, $R_2$ is

Variables →

| | 1 | 2 | 3 | 4 |
|---|---|---|---|---|
| 1 | 0.100E+01 | 0.100E+01 | −0.554E+00 | 0.554E+00 |
| 2 | 0.100E+01 | 0.100E+01 | −0.555E+00 | 0.554E+00 |
| 3 | −0.554E+00 | −0.555E+00 | 0.100E+01 | −0.100E+01 |
| 4 | 0.554E+00 | 0.554E+00 | −0.100E+01 | 0.100E+01 |

THIRD OF 3 GROUPS OF 3 WELLS AND 4 VARIABLES

| VARIABLES | i=1 | l=2 | i=3 | i=4 |
|---|---|---|---|---|
| WELLS | N = 1 | = 2 | = 3 | = 4 |
| j= 1 | 7000.00000 | 12.10000 | 3875.00000 | 35.00000 |
| j= 2 | 7250.00000 | 12.00000 | 4000.00000 | 48.00000 |
| j= 3 | 8000.00000 | 12.80000 | 3950.00000 | 40.00000 |

MEANS OF THIRD GROUP

| $\bar{X}_i$=1 | $\bar{X}_i$=2 | $\bar{X}_i$=3 | $\bar{X}_i$=4 |
|---|---|---|---|
| 7416.66406 | 12.2999926 | 3941.66650 | 41.0000000 |

STANDARD DEVIATIONS OF THIS GROUP ARE:

| $s_i$=1 | $s_i$=2 | $s_i$=3 | $s_i$=4 |
|---|---|---|---|
| 520.453613 | 0.4361027 | 62.8649292 | 6.5574389 |

VARIANCE-COVARIANCE MATRIX, $C_{ik}$ is:

Variables →

| | 1 | 2 | 3 | 4 |
|---|---|---|---|---|
| 1 | 0.271E+06 | 0.213E+03 | 0.115E+05 | 0.375E+03 |
| 2 | 0.213E=03 | 0.190E+00 | 0.625E−01 | −0.699E+00 |
| 3 | 0.115E+05 | 0.625E−01 | 0.395E+04 | 0.400E+−3 |
| 4 | 0.375E+03 | −0.699E+00 | 0.400E+03 | 0.430E+02 |

CORRELATION MATRIX, $R_3$ is:

-continued

THIRD OF 3 GROUPS OF 3 WELLS AND 4 VARIABLES

Variables ⟶

| | | | | |
|---|---|---|---|---|
| 1 | 0.100E+01 | 0.937E+00 | 0.350E+00 | 0.110E+00 |
| 2 | 0.937E+00 | 0.100E+01 | 0.228E−02 | −0.245E+00 |
| 3 | 0.350E+00 | 0.228E−02 | 0.100E+01 | 0.970E+00 |
| 4 | 0.110E+00 | −0.245E+00 | 0.970E+00 | 0.100E+01 |

These matrices are weighted and summed together to get the pooled within groups matrix W for all wells in all the groups:

POOLED MATRIX W of original data:

Variables ⟶

| | 1 | 2 | 3 | 4 |
|---|---|---|---|---|
| 1 | 0.117E+07 | 0.475E+03 | −0.227E+−6 | 0.750E+03 |
| 2 | 0.475E+03 | 0.169E+01 | 0.250E+03 | 0.660E+01 |
| 3 | −0.227E+06 | 0.250E+03 | 0.235E+06 | 0.127E+04 |
| 4 | 0.750E+03 | 0.660E+01 | 0.127E+04 | 0.327E+03 |

TOTAL NO. OF WELLS = 9

The overall statistics for wells in all groups combined are:

MEANS FOR TOTAL SAMPLE $\overline{X}_i$

| $\overline{X}_i$=1 | =2 | =3 | =4 |
|---|---|---|---|
| 7555.5547 | 12.2889 | 4058.3333 | 42.1111 |

STANDARD DEVIATION VECTOR $S_i$ FOR TOTAL SAMPLE

| $S_i$=1 | =2 | =3 | =4 |
|---|---|---|---|
| 1882.3816 | 1.3643 | 581.2178 | 16.3359 |

TOTAL CORRELATION MATRIX

Variables ⟶

| | 1 | 2 | 3 | 4 |
|---|---|---|---|---|
| 1 | 0.100E+01 | 0.943E+00 | 0.905E+00 | 0.904E+00 |
| 2 | 0.943E+00 | 0.100E+01 | 0.927E+00 | 0.902E+00 |
| 3 | 0.905E+00 | 0.927E+00 | 0.100E+01 | 0.892E+00 |
| 4 | 0.904E+00 | 0.902E+00 | 0.892E+00 | 0.100E+01 |

The between group distances about the grand means over all wells is calculated:

Variables ⟶

| | 1 | 2 | 3 | 4 |
|---|---|---|---|---|
| 1 | 0.272E+08 | 0.189E+05 | 0.815E+07 | 0.222E+06 |
| 2 | 0.189E+05 | 0.132E+02 | 0.563E+04 | 0.154E+03 |
| 3 | 0.815E+07 | 0.563E+04 | 0.247E+07 | 0.665E+05 |
| 4 | 0.222E+06 | 0.154E+03 | 0.665E+05 | 0.181E+04 |

The eigenvectors of the total correlation matrix are extracted:

EIGENVALUE 1 73.3556061

EIGENVALUE 2 0.2083998 and checks are made to establish the precision of the results (all checks should be the same value):

$(B^{\frac{1}{2}})^{-1}A\,(B^{\frac{1}{2}})$ where "−1" is the transpose of $B^{\frac{1}{2}}$ where $W^{-1}A$=Trace thereof where "−1" indicates the inverse of W

SUM OF EIGENVALUES=73.5640259

TRACE OF $(B^{\frac{1}{2}})^{-1}$ PRIME *A* $(B^{\frac{1}{2}})$=73.5639648

ROOTS OF $(W^{-1})$*A 73.3556 0.2084

TRACE OF $W^{-1}$ *A=73.56403 and the percentage of the variation in the data explained by each eigenvalue should sum to 100%:

PERCENTAGE WHICH EACH ROOT IS 99.7167 0.2833

The discriminant functions are calculated as:

VECTORS OF $W^{-1}$ *A, AS COLUMNS $W^{-1}$ A, where "−1" indicates the inverse of W Eignevectors or Dicriminant functions Variables Discriminant Functions ⟶

| | 1 | 2 |
|---|---|---|
| 1 | 0.244E−02 | 0.139E−03 |
| 2 | −0.100E+01 | −0.100E+01 |
| 3 | 0.492E−02 | 0.206E−02 |
| 4 | 0.274E−01 | −0.809E−02 |

A simple explanation of the derivation of the eignevalues and the discriminant function is given as follows:

Take some Matrix Q and solve the determinantal equation:

$$|Q-\lambda I|\,v_i=0$$

where I is the identity matrix, λ is the eigenvalue and $v$ is the eigenvector.

Find the eignevalues and eigenvectors of where $$Q=\begin{bmatrix}1 & 3\\ 2 & 2\end{bmatrix}$$

1. eigenvalues are found $$(Q)-(\lambda I)=0$$

$$\begin{vmatrix}1 & 3\\ 2 & 2\end{vmatrix}-\begin{vmatrix}\lambda & 0\\ 0 & \lambda\end{vmatrix}=0$$

$$\begin{vmatrix}1-\lambda & 3\\ 2 & 2-\lambda\end{vmatrix}=0=(1-\lambda)(2-\lambda)-6$$

or $$=2\lambda^2-3\lambda-4=0$$

hence we find:

by inspection $$\lambda_1=4$$

-continued $\lambda_2 = -1$

2. The associated eigenvectors are found by substitution:

For $\lambda_1=4$ $$\begin{pmatrix} 1-\lambda_1 & 3 \\ 2 & 2-\lambda_1 \end{pmatrix}\begin{pmatrix} x_1 \\ x_2 \end{pmatrix} = 0 \text{ or } \begin{pmatrix} -3 & 3 \\ 2 & -2 \end{pmatrix}\begin{pmatrix} x_1 \\ x_2 \end{pmatrix} = 0$$

Note coefficient matrix has rank=1 which implies there exists one linear independent solution vector, all other are multiples of this.

By inspection $$v_1\begin{pmatrix} 1 \\ 1 \end{pmatrix}$$

is the vector.

b. For $\lambda_2-1$.

$$\begin{pmatrix} 1-\lambda_2 & 3 \\ 2 & 2-\lambda_2 \end{pmatrix}\begin{pmatrix} x_1 \\ x_2 \end{pmatrix} = 0 \begin{pmatrix} 2 & 3 \\ 2 & 3 \end{pmatrix}\begin{pmatrix} x_1 \\ x_2 \end{pmatrix} = 0$$

Again there exists only one solution vector $$v2\begin{pmatrix} 3 \\ -2 \end{pmatrix}.$$

Hence the eigenvalues are 4 and 31 1. and the eignevectors are $$v_1\begin{pmatrix} 1 \\ 1 \end{pmatrix} \text{and } v_2\begin{pmatrix} 3 \\ -2 \end{pmatrix}$$

respectively.

The eigenvectors can be thought of as the discriminant functions and are the discriminant functions when properly normalized.

This example does not have the same properties of the correlation matrix, as one of the eigenvalues in this example is negative. This was selected, because a sample matrix as presented in the example of 3 groups is somewhat too complex to be readily solved by a hand calculator. However, the matrix of the Example may be solved by a program similar to those of SAS (Statistical Analysis System, SAS Institute, Raleigh, N.C., or BMDP4, UCLA, Los Angeles, Calif.). In such solution, after the eigenvectors are obtained, they are scaled to show the relative importance of each variable to the discriminant function as follows:

SCALED VECTORS

Variables Discriminant Functions ---->

| | 1 | 2 |
|---|---|---|
| 1 | 0.264E+01 | 0.150E+00 |
| 2 | −0.130E+01 | −0.130E+01 |
| 3 | 0.238E+01 | 0.996E+00 |
| 4 | 0.495E+00 | −0.146E+00 |

The statistical tests for significance are made using the Wilk's Lambda criterion and the F-ratio.

LAMBDA FOR TEST OF $H_2$=0.0111295

$F_1$=8.0000000=degrees of freedom of the numerator $F_2$=6.0000000=degrees of freedom of the demoninator.

FOR TEST OF $H_2$ with degrees of freedom ($F_1$,$F_2$), F=6.3592415

Where $H_2$ is the null hypothesis that no relationships exist.

These were significant at the 0.01 probability level, i.e., there is 1 chance in 100 that the observed results could have arisen by chance.

Each well's discriminant value is calculated by multiplying the original data by the discriminant coefficient pertaining to each variable and summing the results for the four variables for each well in each group:

| N | 1 | 2 |
|---|---|---|
| ORIGINAL TIMES EIGENVECTORS - FIRST GROUP OF WELLS | | |
| 1 | 35.370758 | −3.142392 |
| 2 | 34.916916 | −3.382162 |
| 3 | 34.803467 | −2.860050 |
| ORIGINAL TIMES EIGENVECTORS - SECOND GROUP OF WELLS | | |
| 4 | 21.395081 | −2.596268 |
| 5 | 19.700882 | −2.709401 |
| 6 | 20.248352 | −3.924898 |
| ORIGINAL TIMES EIGENVECTORS - THIRD GROUP OF WELLS | | |
| 7 | 24.999207 | −3.441051 |
| 8 | 26.679733 | −3.154366 |
| 9 | 27.245026 | −3.888223 |

This completes the main discriminant analysis. The results of each well in each of the three groups of wells may then be plotted in either an orthogonal plot or in a triangular form, as in FIG. 12.

The probabilities of correct classification are calculated from:

MEANS OF GROUPS IN TEST SPACE

Variables ---->

Groups

| | | | |
|---|---|---|---|
| 9750.00000 | 13.7666626 | 4750.00000 | 60.0000000 |
| 5500.00000 | 10.7999973 | 3483.33325 | 25.3333282 |
| 7416.66406 | 12.2999926 | 3941.66650 | 41.0000000 |

CENTROIDS OF GROUPS IN DISCRIMINANT SPACE, ROW-WISE

Discriminant Function Means ---->

| Groups | | | |
|---|---|---|---|
| | 35.0303802 | −3.1281977 | Joint discriminant means of the 3 Groups. |
| | 20.4481049 | −3.0768538 | |
| | 26.3079834 | −3.4945393 | |

DISPERSION OR STANDARD DEVIATION VECTORS IN DISCRIMINANT SPACE FOR GROUP 1

Discriminant Functions---->

| | |
|---|---|
| 0.0901396 | −0.0185371 |
| −0.0185374 | 0.0683792 |

-continued

DISPERSION IN DISCRIMINANT SPACE FOR GROUP 2

Discriminant Functions ⟶

| | |
|---|---|
| 0.7482136 | 0.1753250 |
| 0.1753258 | 0.5427456 |

DISPERSION IN DISCRIMINANT SPACE FOR GROUP 3

Discriminant Functions ⟶

| | |
|---|---|
| 1.3636608 | −0.1567893 |
| −0.1567892 | 0.1366703 |

Using a Chi-squared approximation to a Bayesian statistic the probabilities are found.

| | CHI-SQUARED VALUES OF GROUP | | | PROBABILITY OF CORRECT CLASSIFICATION | | |
|---|---|---|---|---|---|---|
| | 1 | 2 | 3 | 1 | 2 | 3 |
| 1 | 1.334 | 322.918 | 76.613 | 1.000 | 0.000 | 0.000 |
| 2 | 1.334 | 307.021 | 64.589 | 1.000 | 0.000 | 0.000 |
| 3 | 1.331 | 295.166 | 74.808 | 1.000 | 0.000 | 0.000 |
| 4 | 2142.553 | 1.332 | 18.637 | 0.000 | 1.000 | 0.000 |
| 5 | 2722.738 | 1.333 | 32.018 | 0.000 | 1.000 | 0.000 |
| 6 | 2652.085 | 1.333 | 37.634 | 0.000 | 1.000 | 0.000 |
| 7 | 1203.734 | 31.762 | 1.335 | 0.000 | 0.000 | 1.000 |
| 8 | 820.693 | 56.615 | 1.337 | 0.000 | 0.000 | 1.000 |
| 9 | 758.760 | 73.265 | 1.333 | 0.000 | 0.000 | 1.000 |

Figure 12:
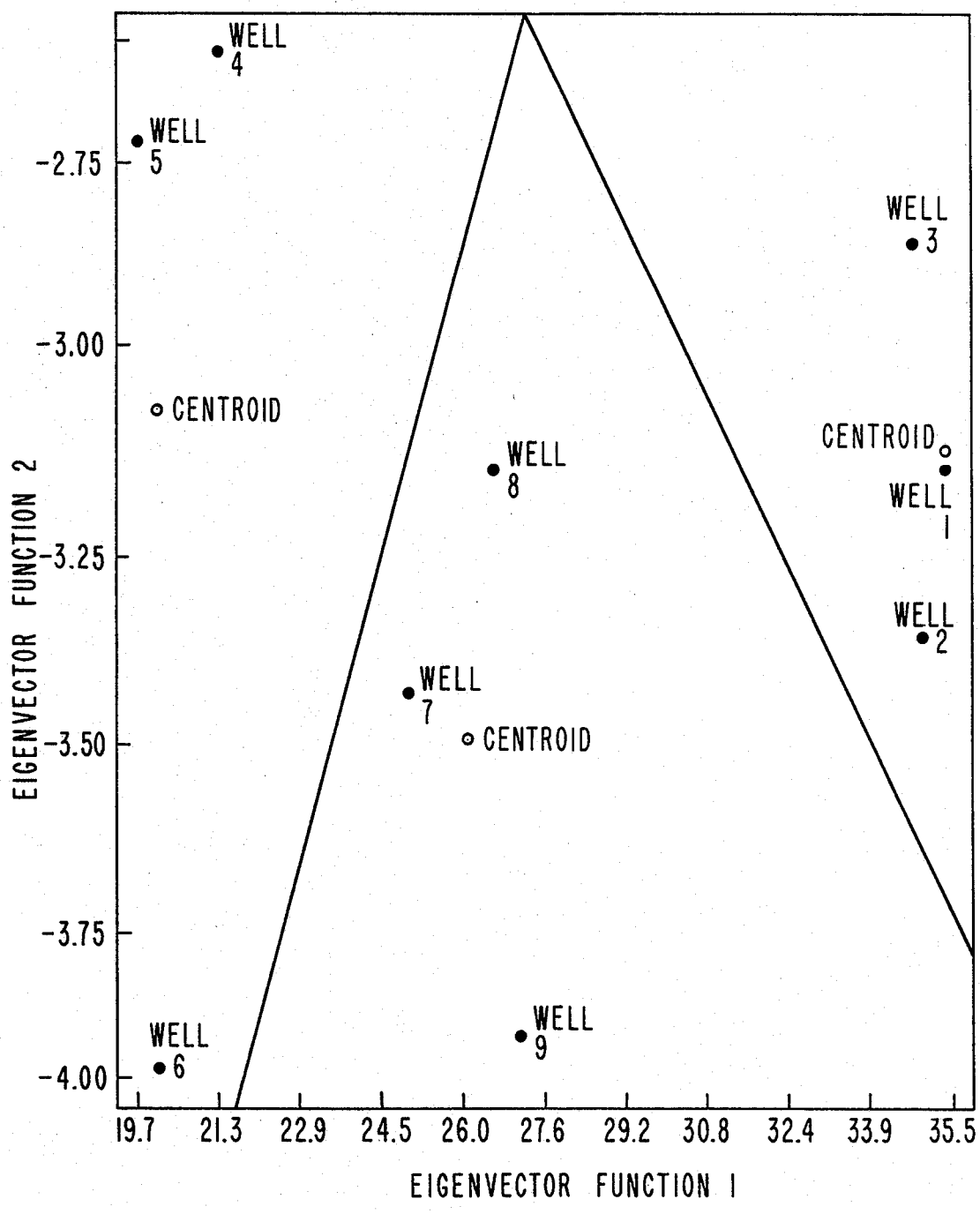
FIG. 12 is a plot of well vectors generated by an explanatory example of four measurable variables in three wells in each of three different groups or classes of wells, and the centroids of each group as calculated by a computer program.

The results of these groups plotted in accordance with their eigenvectors is shown in FIG. 12 wherein the nine wells are each plotted by their eigenvector coordinates. The separation of the three groups is indicated.

Best Mode

From the foregoing example, it will be seen that for twenty or more measured variables at one depth in each well and for 40 to 100 wells in each of the three classes, the calculations and graphic representations of each well are best performed by computer.

The calculations of each dimensionless matrix coefficient can be calculated with an HP35 (Hewlett Packard) hand-held computer for a few variables and wells. However, for large data sets, say 20 variables and 80 wells in each of three matrices, a program known as SAS, available from SAS Institute, Raleigh, N.C., will perform statistical analysis as above described. Such program is capable of performing all steps of multivariate analysis, including matrix computation of principal components, factors, regression and discriminant analysis. Additionally, a text book by W. W. Cooley and P. R. Lohnes, "Multivariate Procedures for the Behavioral Sciences", John Wiley and Sons, New York, N.Y., 1962 presents FORTRAN code for statistical analysis. The graphic presentation of the three classes of wells and location of each well vector may be plotted using a program known as Lotus 1-2-3 available commercially from Lotus Development, Cambridge, Mass. It can be used together with a program known as dBASE III, available from Ashton-Tate, Culver City, Calif. to manage the data file. Linear programs for calculating each individual well vector to plot and control a drilling well can be performed by a program known as OMNI, available from Haverly Systems, Inc., Denville, N.J.. Program MPSX, available from IBM Corp., White Plains, N.Y. may also be used.

In a field application of the method of the present invention, the following commonly measured well variables or parameters were used to set up the matrices.

(1) Measured well depth, feet
(2) true vertical well depth, feet
(3) open (uncased) hole length, feet
(4) rotary drill string drive torque
(5) rotary drill string drag,
(6) survey hole angle (from vertical), degrees
(7) drilling fluid (mud) weight, lbs./gal
(8) drilling fluid plastic viscosity,
(9) drilling fluid yield point,
(10) drilling fluid 10 second gel strength,
(11) drilling fluid 10 minute gel strength,
(12) API standard drilling fluid water loss (filtrate),
(13 drilling fluid pH,
(14) drilling fluid chlorides content,
(15) bore hole size (diameter),
(16) drilling fluid solids percent,
(17) drilling fluid water percent,
(18) drilling fluid flow (pumping) rate,
(19) drill collar outside diameter, and
(20) vertical length of drill collar section of drill pipe.

All variables are measured in accordance with API standards.

Various measures of gas content of drilling fluid, and gas type, have also been used with success.

In development of the well vector coefficients using multivariate analysis of the above-listed multiplicity of measured variables in a multiplicity of wells drilled in the subject geological province, the relative importance of the individual coefficients for each variable to redirect the probability vector of a drilling well between the groups were as listed in Table 1.

TABLE 1

IMPORTANCE OF VARIABLES IN ORDER OF SIGNIFICANCE AT 90% CONFIDENCE LEVEL

| OVERALL | STUCK vs. NOT STUCK | MECH vs. DIFF |
|---|---|---|
| SURVEY ANGLE | SURVEY ANGLE | HOLE SIZE |
| HOLE SIZE | TRUE VERITICAL | SURVEY |
| TRUE VERTICAL | DEPTH | ANGLE |
| DEPTH | HOLE SIZE | DRAG |
| DRAG | OPEN HOLE | MUD |
| OPEN HOLE | 10 MIN GEL | WEIGHT |
| FLOW RATE | 10 SEC GEL | WATER LOSS |
| MUD WEIGHT | PERCENT WATER | CHLORIDES |
| CHLORIDES | PERCENT SOLIDS | 10 SEC GEL |
| WATER LOSS | PLASTIC VISCOSITY | |
| | TORQUE | |
| | DRILL COLLAR O.D.* | |

(*Significant only at 89% confidence level.)

In the list of variables the "Overall" column refers to movement of a well vector from one location to another on the plot or map. The "Stuck vs Not Stuck" column indicates the relative importance of modifying a measured variable to move from a Stuck well (differential or mechanical) area toward the Not-Stuck centroid. The "Mech. vs. Diff." column indicates the relative importance of each measured variable as between a position of well vector in the mechanically stuck class rather than differentially stuck class.

At a confidence level of 85% or less, the drilling fluid variables, pH and yield point, and the variables, measured depth of the well bore and drill collar length were not significant partly due to high correlations with other variables recorded at the 90% significance level, i.e., they were redundant.

Based on the method of the present invention, a study was made of 35 wells not used in the original data to determine the probability of correctly predicting sticking of drill pipe in a well bore drilled in the given geological province. A total of 49 predictions were made and in 41 cases the final outcome was correctly predicted as to its being properly classified into each of the three groups. Table I sets forth the results of such predictions at the indicated depths in the 35 wells. Overall, such predictions were 82%-84% correct, depending upon what weight one gave to two wells which had multiple cases of sticking over large depth ranges.

TABLE 2

SUMMARY OF FIELD RESULTS USING STUCK DRILL PIPE PROGRAM

| WELL | MAXIMUM DEPTH | ACTUAL CONDITION | PREDICTED CONDITION |
|---|---|---|---|
| 1 | 6570 | NSTK | NSTK |
| 2 | 7556 | NSTK | NSTK |
| 3 | 10986 | NSTK | DIFF |
| 4 | 7708 | NSTK | NSTK |
| 5 | 5547 | NSTK | NSTK |
| 6 | 4875 | NSTK | NSTK |
| 7 | 9608 | NSTK | NSTK |
| 8 | 12019 | NSTK | NSTK |
| 9 | 6536 | NSTK | NSTK |
| 10 | 10998 | NSTK | NSTK |
| 11 | 5465 | NSTK | NSTK |
| 12 | 15139 | NSTK | NSTK |
| 13 | 9893 | DIFF | DIFF |
| | 11130 | DIFF | DIFF |
| ST/#1 | 10701 | DIFF | DIFF |
| 14 | 7238 | DIFF | DIFF |
| ST/#1 | 10388 | NSTK | MECH |
| 15 | 9674 | NSTK | NSTK |
| 16 | 7993 | NSTK | NSTK |
| 17 | 12627 | DIFF | DIFF |
| | 12999 | DIFF | DIFF |
| ST/#1 | 13823 | DIFF | DIFF |
| | 14036 | DIFF | DIFF |
| 18 | 7673 | DIFF | NSTK |
| 19 | 14089 | DIFF | DIFF |
| | 15073 | DIFF | DIFF |
| 20 | 10096 | NSTK | NSTK |
| 21 | 8674 | NSTK | DIFF |
| 22 | 13409 | NSTK | DIFF |
| 23 | 5316 | MECH | MECH |
| | 6360 | MECH | MECH |
| | 8373 | MECH | MECH |
| | 12055 | MECH | MECH |
| | 12677 | MECH | MECH |
| 24 | 17276 | NSTK | NSTK |
| 25 | 9606 | MECH | MECH |
| 26 | 9846 | NSTK | DIFF |
| 27 | 10125 | NSTK | NSTK |
| 28 | 21045 | NSTK | NSTK |
| 29 | 12560 | NSTK | NSTK |
| 30 | 7520 | DIFF | DIFF |
| 31 | 7510 | DIFF | DIFF |
| 32 | 11849 | MECH | MECH |
| | 13522 | NSTK | DIFF |
| 33 | 5421 | NSTK | NSTK |
| 34 | 16506 | DIFF | DIFF |
| 35 | 14691 | NSTK | DIFF |

(ST/# indicates that the well was sidetracked and redrilled from a level above the previous depth at which the drill pipe stuck to the next depth.)

While in the above description, it is clearly preferable to determine the probability of a drill string sticking using three groups of wells, the method is clearly applicable to separation into only two groups. Such two groups may comprise all stuck wells and those not stuck or those freed and those not freed. Alternatively, the analysis is applicable to distinguishing only mechanical sticking from differential sticking. Corrective action for the measured variables, as each simultaneously contributes to the well vector at a particular depth, as related to the entire suite of wells, is indicated by the individual coefficients for each variable. It will be understood that the measured variables which (1) make the greatest contribution to direct the well vector toward the non-stuck controid and (2) can most easily be modified in drilling the well may be evaluated before such variables are in fact changed.

Based on discriminant plots as shown in FIGS. 9 and 10 to plot wells on a daily basis, optimal values of the twenty variables to move the well into the not stuck region may be calculated using a linear program (LP). The LP, using reasonable values for the given well, mud type, and hole conditions, calculates the amount and extent of changes in the variables of the discriminant equation required to achieve the specified goal of collectively changing the variables to reach or approach the centroid of the not stuck wells.

Unfortunately, the LP does not necessarily change the variable in a manner consistent with common sense. For instance, in order to achieve the desired goal, the LP could drive the mud weight to a negative value. Therefore, it is necessary to constrain the variables within the LP to maintain reasonable engineering values.

Two types of constraints are used: function constraints relating some of the variables, and boundary constraints to keep the variables within reasonable limits. The functional constraints are:

(1) An equation relating percent solids to mud weight in the drilling fluid.

(2) Ten second gel values for drilling fluid cannot exceed ten minute gel values.

(3) The sum of the drilling fluid content, solids percent and fluids percent, cannot exceed 100%.

Boundary conditions or constraints are then set for the minimum and maximum value of each of the twenty variables and the target coordinates (42 constraints total). These five equations and forty-two boundary conditions comprise the LP matrix. Target location coordinates in the not stuck region are then also assigned and equated to the two discriminant functions. The matrix is then solved by approaching the target discriminant values as closely as possible without violating any of the five equations or forty two variable constraints.

The LP optimization system may use, for example, Ashton-Tate's dBase III for the input and output routines and Fortran for the LP matrix solution. Table 3 illustrates the LP input. The Current Values (Column 2) of the twenty Variables (Column 1) are input along with the target coordinates. Lower and Upper Limits (Columns 3 & 4 respectively) are then assigned and the allowable range Down or Up (Columns 5 and 6) of each variable if, indeed any change is possible, are set. As shown, in fact eight of the twenty variables cannot be changed on any given day. (It is also to be noted that limits are also assigned to the target to allow some leniency in the solution of the matrix.)

From this input an LP matrix is created and solved. Periodically a solution is not possible within the given boundary conditions. The constraints on the target area must then be relaxed and the LP rerun. An example LP output is shown in Table 4. The new proposed LP Values (Column 1) are shown along with the actual Current Values (Column 2). The proposed differences (Column 3) and the new values of the changed variable within the given limits are then shown in Columns 4 and 5. The X and Y target values are then plotted relative to the current X and Y coordinates of the drilling well.

Accordingly, the user is presented current values during any point in drilling a well bore. The user is then allowed to change some, but not all, variables (e.g.,the well bore shallower). Upper and lower limits are then set on the variables that can be so changed. This then permits plotting the current location on the probability plot and shows the "safe" position to achieve the highest probability of not sticking the drill pipe. In the results shown in Table 4, it will be noted that among significant changes that could be made the operator can increase the mud weight 0.5 lbs/ft$^3$, decrease the drilling fluid water loss 2.3% and decrease the chlorides content of the drilling fluid 2000 ppm. Other modifications such as drill collar diameter (increase) and length (decrease) are as indicated.

TABLE 3

LP DATA INPUT

WELL: EXAMPLE
DATE: 06/12/85

| VARIABLE | CURRENT VALUE | WELL VARIABLE REPORT LOWER LIMIT | UPPER LIMIT | STUCK DRILL PIPE OPTIMIZATION SYSTEM DOWN | UP |
|---|---|---|---|---|---|
| Measured Depth, feet | 11000 | 11000 | 11000 | 0 | 0 |
| True Vertical Depth, feet | 10000 | 10000 | 10000 | 0 | 0 |
| Casing Depth, feet | 4500 | 4500 | 4500 | 0 | 0 |
| Openhole Length, feet | 6500 | 6500 | 6500 | 0 | 0 |
| Torque | 15000 | 15000 | 15000 | 0 | 0 |
| Drag | 50000 | 50000 | 50000 | 0 | 0 |
| Survey Angle, degrees | 25.00 | 25.00 | 25.00 | 0.00 | 0.00 |
| Mud Weight, lb/gal | 12.0 | 11.5 | 12.5 | 0.5 | 0.5 |
| Plastic Visc. | 12 | 8 | 16 | 4 | 4 |
| Yield Point | 5 | 3 | 11 | 2 | 6 |
| 10 Sec. Gel | 1 | 0 | 4 | 1 | 3 |
| 10 Min. Gel | 4 | 2 | 10 | 2 | 6 |
| Water Loss | 3.5 | 1.0 | 4.5 | 2.5 | 1.0 |
| pH | 11.0 | 9.5 | 12.5 | 1.5 | 1.5 |
| Chlorides, ppm | 4000 | 2000 | 14000 | 2000 | 10000 |
| Solids, percent | 20 | 12 | 18 | 8 | −2 |
| Water, percent | 80 | 75 | 85 | 5 | 5 |
| Hole Size, inches | 12.250 | 12.250 | 12.250 | 0.000 | 0.000 |
| Mud Flow Rate, ft3/min | 8.000 | 7.500 | 9.500 | 0.500 | 1.500 |
| Drill Collar OD, inches | 8.000 | 7.500 | 9.500 | 0.500 | 1.500 |
| Drill Collar length, ft. | 350 | 150 | 650 | 200 | 300 |
| X Target | −16.00 | −16.50 | −15.50 | 0.50 | 0.50 |
| Y Target | −9.00 | −9.50 | −8.50 | 0.50 | 0.50 |
| X Coor | −12.86 | | | | |
| Y Coor | −7.97 | | | | |

TABLE 4

LP OPTIMIZATION REPORT

WELL: EXAMPLE
DATE: 06/12/85
* LP SOLUTION IS OPTIMAL*

| VARIABLE | LP VALUE | CURRENT VALUE | DIFFERENCE | STUCK DRILL PIPE OPTIMIZATION SYSTEM LOWER LIMIT | UPPER LIMIT |
|---|---|---|---|---|---|
| Measured Depth feet | 11000 | 11000 | 0 | 11000 | 11000 |
| True Vertical Depth, feet | 10000 | 10000 | 0 | 10000 | 10000 |
| Casing Depth, feet | 4500 | 4500 | 0 | 4500 | 4500 |
| Openhole Length, feet | 6500 | 6500 | 0 | 6500 | 6500 |
| Torque | 15000 | 15000 | 0 | 15000 | 15000 |
| Drag | 50000 | 50000 | 0 | 50000 | 50000 |
| Survey Angle, degrees | 25.00 | 25.00 | 0.00 | 25.00 | 25.00 |
| Mud Weight, lb/gal | 12.5 | 12.0 | 0.5 | 11.5 | 12.5 |
| Plastic Visc. | 16 | 12 | 4 | 8 | 16 |
| Yield Point | 5 | 5 | 6 | 3 | 11 |
| 10 Sec. Gel | 1 | 1 | 3 | 0 | 4 |
| 10 Min. Gel | 7 | 4 | 3 | 2 | 10 |
| Water Loss | 1.2 | 3.5 | −2.3 | 1.0 | 4.5 |
| pH | 12.5 | 12.5 | 1.5 | 9.5 | 12.5 |
| Chlorides, ppm | 2000 | 4000 | −2000 | 2000 | 14000 |
| Solids percent | 16 | 20 | −4 | 12 | 18 |
| Water percent | 84 | 80 | 4 | 75 | 85 |
| Hole Size inches | 12.250 | 12.250 | 0.000 | 12.250 | 12.250 |
| Mud Flow Rate ft$^3$/min | 525 | 450 | 75 | 375 | 525 |
| Drill Collar OD inches | 9.500 | 8.000 | 1.500 | 7.500 | 9.500 |
| Drill Collar length ft. | 150 | 350 | −200 | 150 | 650 |
| X Target | −15.75 | −16.00 | 0.25 | −16.50 | −15.50 |
| Y Target | −9.50 | −9.00 | −0.50 | 9.50 | 8.50 |
| X Coor | | −12.86 | | | |

TABLE 4-continued

LP OPTIMIZATION REPORT

WELL: EXAMPLE
DATE: 06/12/85
* LP SOLUTION IS OPTIMAL*

| VARIABLE | LP VALUE | CURRENT VALUE | DIFFERENCE | STUCK DRILL PIPE OPTIMIZATION SYSTEM LOWER LIMIT | UPPER LIMIT |
|---|---|---|---|---|---|
| Y Coor | | −7.97 | | | |

Various modifications and changes in the method of the present invention will become apparent to those skilled in the arts of statistical analysis and well drilling from the foregoing specification. Such modifications may include planning an overall drilling program before the well is drilled, or even "spudded". In so using the method of the invention, from the beginning the multiplicity of variables are controlled on a periodic basis, say daily, to maintain the well vector within allowable limits. In this way, throughout drilling the vector is kept adjacent the not-stuck centroid of wells drilled in the same or a similar geological province. Thus, the probability of not sticking the drill pipe in a directional well may be substantially improved.

Other modifications and changes coming within the spirit and scope of the following claims are intended to be included therein.

We claim:

1. A method of utilizing multivariate statistical analysis of a multiplicity of measured well drilling variables to decrease the probability of sticking a drill string during the drilling of a well bore which comprises:

recording in matrix form a similar multiplicity of measured variables at given depths in each of a multiplicity of wells, including at least two classes of wells elected as members of groups comprising wells wherein the drill string (1) did not stick, and (2) did stick determining for each well within said matrix a vector formed by the sum of the contributions of the eigenvector values for each measured variable in said multiplicity of measured variables, recording the mean value of the group of well vectors in each of said group (1) and (2) wells formed by their individual group matrices, then in drilling said well bore summing the products of the contribution to each eigenvector value multiplied by each of the corresponding measured variable of said multiplicity of variables at the current depth of a drilling well to form the coordinates of the current well vector of said drilling well at said current depth, relative to said mean values of each of said two groups of wells, plotting said current drilling well vector relative to said mean values of said at least two groups of wells to indicate the probable location of said well vector due to current drilling conditions in said well bore, modifying at least one condition in said drilling well by changing the value of at least one of said measured. variables within a physically feasible range for said variable to indicate the effect of so modifying said variable to decrease the probability of sticking a drill string in said well by moving said current drilling well vector away from the mean of said stuck well vectors; and continuing the drilling of said well bore using the changed value of said measured variable with improved probability that the well vector will move away from said mean of said group of stuck wells toward the mean of said group of wells that did not stick.

2. The method of claim 1 wherein additionally the multiplicity of variables in each of said group of wells that did stick are recorded in two separate matrices and the mean of the well vectors of said two additional matrices are plotted relative to the mean for said group of not stuck well vectors and a grand mean of the resulting three groups of wells is recorded, and the values of a plurality of said measured variables in said current drilling well are modified, said variables including the drilling fluid properties and the circulating system of the drilling fluid circulating through the drill string and said well bore.

3. The method of claim 2 wherein said measured variables further include the bottom hole assembly of the drill string and casing configuration in the bore hole.

4. A method directing a drilling well in a given geological province to avoid drill string sticking in the well bore which comprises forming a multivariate analysis similarity matrix of a multiplicity of measured variables in a multiplicity of wells for at least two classes of wells in said geologic province, said two classes including wells selected from the groups consisting of (1) those that stuck the drill pipe and (2) wells that did not stick the drill pipe, said multivariate analysis similarity matrix for each well in each class including the measured values of a multiplicity of substantially identical measurable variable quantities in each well representative of the drilling fluid used in drilling said well and the mechanical relationships between the drill string and bore hole at a selected depth interval in each well, each class of wells forming a plurality of vectors and each vector representing said measured values of said variable quantities in one well in its respective matrix, each of said well vectors being the sum of the measured value of each of said variable quantities scaled by its corresponding coefficients of its matrix, determining a mapping surface adequately separating said at least two classes of well vectors said mapping surface being generally centered about a grand mean for plotting at least the centroids of the projections of said well vectors from each of said two classes, and said centroids establishing the probability of each well vector being properly classified, then measuring substantially the same multiplicity of variable quantities at a selected depth in a drilling well, generating a vector for said drilling well representative of the relation of each of said variable quantities in said drilling well to the variable quantities of wells represented by said centroid projections on said mapping surface, the position of said drilling well vector being determined by the sum of the products of the matrix coefficient values of each measured variable quantity and the corresponding value of the measured variable quantities in said well determining the effect of modifying selected ones of the measured variable quantities of said drilling fluid and mechanical relationships between the drill pipe and said well to direct or maintain said well vector away from the centroid of well vectors of wells that stuck the drill pipe, and, continuing the drilling of said well using the so modified values of said measured variable quantities to direct or maintain said well vector away from said stuck drill pipe well vector centroid.

5. A method of determining the statistical probability of sticking drill pipe during drilling of a well bore to modify and thereby avoid drilling conditions in accordance with said probability of sticking the drill pipe in a well bore which comprises:

in a multiplicity of well bores drilled in a geological province calculating the relationship between a multiplicity of measured variable mechanical quantities dependent upon the relationships between the drill string including the drill collar length and diameter, the well bore depth, casing depth, angle and diameter, and measured variable physical quantities of the drilling fluid used in drilling said well bore, said multiplicity of well bores including a first multiplicity of wells in which the drill string stuck and a second multiplicity of wells in which the drill string did not stick, separately calculating the relationship of the same multiplicity of said measured mechanical quantities and drilling fluid quantities in each of said first and second multiplicity of wells, determining by multivariate analysis of substantially all of said measured variable mechanical quantities and drilling fluid quantities in each of said wells of each of said first and second multiplicities of wells a plotting surface wherein centroids of vectors representative of each well in said first and second multiplicities are adequately separated as groups from each other on said plotting surface to establish the probability of each well being correctly assigned to one of said first and second multiplicities of wells, then, measuring substantially the same variable mechanical quantities and drilling fluid quantities at a given depth in another well being drilled in said geological province, generating a well vector of said other well in accordance with the relative contribution of each measured variable quantity to said vector in accordance with said multivariate analysis, plotting said well vector on said plotting surface relative to at least the centroids of the vectors of said multiplicities of wells to determine the probability that the measured conditions at said given depth in said other well places said well within one of said first and second multiplicities of wells, modifying a plurality of said measured variable quantities in an amount and to an extent sufficient in said other well to direct or maintain said other well vector away from said first multiplicity of wells and toward said second multiplicity of wells, and after modifying said measured variable quantities in said other well continuing the drilling thereof with reduced probability of sticking said drill pipe.

6. A method of avoiding sticking a drill pipe in a well bore during drilling thereof in accordance with the probability of such sticking occurring by measurement of multiplicity of variable quantities representing substantially all significant drilling conditions for rotation of said drill pipe in said well bore, including mechanical characteristics of said drill string relative to said well bore and physical characteristics of drilling fluid used in drilling said well bore, which comprises:

establishing a probability data base from a multiplicity of wells drilled in a geological province, including at least two classes of wells wherein a drill string has stuck and wells wherein the drill string did not stick, said data base being the well vector solution for each well in the combined matrix of said multiplicity of said variable quantities in all such multiplicity of wells, and wherein said quantities in each of said wells were measured substantially simultaneously at a given drilling depth in its respective well, plotting said well vectors of each of said wells by the coordinates of the points of intersection of their projection onto a plotting surface, each of said vectors being the sum for the relative contribution of each of said multiplicity of said measured variable quantities in its respective well relative to the points of intersections of the projection of all other well vectors in said data base onto said plotting surface, then measuring substantially the same multiplicity of variable quantities in another well that is being drilled and calculating from said data base the well vector solution of said other well relative to said at least two classes of wells, plotting said well vector of said other well on said plotting surface to indicate the probability of sticking said drill pipe by continuing drilling using the same measured variable quantities in said other well, in accordance with said probability modifying at least one of a plurality of said variable quantities in an amount and to an extent in said other well required to direct said well vector into, or maintain said well vector in, the plotted group of vectors for wells wherein the drill string did not stick and continuing the drilling of said other well using the so modified variable quantities.

7. The method in accordance with claim 6 wherein said well vector of said other well is successively plotted at increasing depths in said well and said measured variable quantities are similarly modified in accordance with the locations of said successive well vectors to direct or maintain said well vector in the drilling of said other well.

8. A method of drilling a well in a given geological province with decreased probability of sticking the drill pipe during drilling which comprises in said province selecting the direction and trajectory of a well to be drilled from a first depth to reach an underground area at a given depth, measuring the value of each of a multiplicity of variables used to control the drilling of a multiplicity of selected wells in said geological provide, each multiplicity of measured variables being made substantially simultaneously at the same depth in any well of said multiplicity of selected wells, each well in one group of said selected wells being at a depth related to where the drill pipe stuck and each well in another group of said selected wells being wells where the drill string did not stick over a depth range similar to those in said group of said selected wells in which the drill pipe stuck.

by multivariate analysis of all of said multiplicity of substantially the same measured variables in said multiplicity of selected wells determining the coefficients of the relative contribution of each measured variable to a well vector defining the relationship of each well to each other well of said multiplicity of selected wells, recording the projection of said vectors with a plotting surface to establish relative to said plotting surface at least the centroid of all vectors of wells at the depth where the drill pipe stuck in each of said one group of said selected wells and the centroid of said other group of said selected wells in which the drill pipe did not stick, and in accordance with the same multiplicity of measured variables at a given depth along said trajectory in said drilling well, generating another well vector corresponding to the sum of the coefficient-weighted values of said variables to record the projection of said drilling well vector at said given depth relative to said centroids, modifying a plurality of said measured variables used to control the further drilling of said well to maintain or move said well vector toward said centroid of the not stuck wells, and continuing the drilling of said well using the so modified variables to decrease the probability of sticking the drill pipe therein.

9. The method of drilling in accordance with claim 8 wherein said multiplicity of measured variables are periodically measured and then controlling the values of the changed variables in accordance with the recording to the well vector for such periodic measurements during drilling of a substantial portion of said well to said given depth.

10. A method of continuously monitoring and correcting the drilling of a well from a given depth in a given geological area to avoid sticking the drill pipe while extending said well over a given depth interval from said given depth to another underground location in a deeper earth formation, which comprise measuring substantially the same multiplicity of variables used to control the drilling of a multiplicity of selected wells in said geological area, the measurement of each of said multiplicity of measured variables being made at substantially a single depth selected within said given depth interval for such measurements in any well of said multiplicity, by multivariate analysis of said multiplicity of substantially the same measured variables in said selected wells determining the coefficients of the relative contribution of each measured variable to a well vector defining the relationship of each well to similar well vectors for each other well of said multiplicity of selected wells, recording the position of each of said well vectors with respect to a plotting surface, said plotting surface separately displaying at least the centroid of said well vectors in each of said wells where the drill pipe stuck and a centroid of said wells vectors in each of said wells where the drill string did not become stuck, and in accordance with substantially the same multiplicity of measured variables at any given depth within said given depth interval in said drilling well, generating another well vector corresponding to the sum of the coefficient-weighted values of said measured variables to indicate on said plotting surface the current position of said drilling well vector relative to said centroids, modifying a plurality of said measured variables in said drilling well in accordance with the position of said drilling well vector relative to the position of said centroids to control the further drilling of said well within said given depth interval so as to maintain or move said well vector toward said centroid of the not stuck well vectors, and continuing the drilling of said well using the so modified variables to avoid sticking of the drill pipe therein.

11. A method for continuously monitoring and correcting the drilling of a well from a given depth in a given geological area to avoid sticking the drill pipe while extending said well from said given depth to a deeper underground location in an earth formation, which comprises measuring the values of a multiplicity of variables used to control the drilling of each of a multiplicity of selected wells in said geological area, the measurement of said values of said multiplicity of measured variables being made within a given depth interval selected for such measurements in any well of said multiplicity, by multivariable analysis of said multiplicity of measured variables in said selected wells determining the coefficients of the relative contribution of each measured variable to a well vector defining the relationship of said well to similar well vectors for each other well of said multiplicity of selected wells, recording each of said well vectors to generate at least one centroid of said well vectors for each of said wells where the drill pipe stuck and at least another centroid of well vectors for each of said wells where the drill string did not stick, and in accordance with said the multiplicity of measured variables at a given depth in said drilling well, generating another well vector corresponding to the sum of the coefficient-weighted values of all said variables to indicate the position of said drilling well vector relative to said centroids and modifying the value of at least one of a plurality so modifying said variable on said drilling well vector for further drilling of said well and in accordance with said effect modifying said variable to maintain or move said well vector toward said centroid of the not stuck wells, and then, drilling said well with said variable so modified to decrease the probability of sticking the drill pipe in said well.

12. The method in accordance with claim 11 wherein the recording of said one centroid of said well vectors for wells where the drill pipe stuck additionally includes separately recording a first centroid of well vectors in which the drill pipe stuck mechanically and a second centroid of well vectors in which the drill pipe stuck by differential pressure.

13. The method in accordance with claim 11 wherein modifying the value of at least one of said plurality of measured variables includes setting a given range of physically feasible values for each measured variable at said given depth in said drilling well to optimize the effect of modifying said variable within said given range to maintain or move said well vector toward said centroid of not stuck well vectors.

14. A method of predicting and correctively altering the drilling of a well bore to avoid the probability of sticking the drill string therein which comprises (a) forming a coefficient matrix of a multiplicity of measured well drilling variables in each of a multiplicity of wells in at least two classes of wells drilled in a similar geologic province, each of said two classes including a multiplicity of wells selected from groups consisting of (1) those that stuck the drill pipe and (2) wells that did not stick the drill pipe, (b) said correlation matrix for each class including for each well in its respective class a multiplicity of substantially identical drilling condition variables measured in each well at a depth within a selected depth interval, (c) said correlation matrix for each class of wells forming a plurality of well vectors, each well vector representing one well in its respective matrix, and each of said well vectors being the sum of the products of the measured variables and its corresponding matrix coefficient, (d) determining a surface separating said at least two groups of well vectors to define a mapping surface for plotting at least the centroid or mean value of the projections of said well vectors from each of said at least two classes of wells said centroids establishing the probability that each well vector is properly classified, (e) then, to reduce the probability of sticking the drill string while continuing drilling of said well, measuring the same drilling condition variables at a selected depth in said drilling well, (f) generating a well vector for said drilling well representative of said drilling condition variables for projection to said surface to indicate the relationship of said drilling well vector to said centroid projections, (g) then modifying selected ones of said measured drilling condition variables in said drilling well in an amount and to an extent to direct said drilling well vector away from the probability centroid of a stuck drill string well and (h) continuing the drilling of said well with the modified drilling condition variables.

15. The method of claim 14 wherein said class of wells in which the drill string stuck is further separated by their well vectors into at least two additional groups including one group of wells in which the drill string stuck mechanically and another group in which the drill string stuck differentially, such separation being by another surface intersecting said mapping surface between the centroid of the well vector of said mechanically stuck wells and the centroid of the well vectors of said differentially stuck wells, and at another depth in the continued drilling of said well repeating steps (e) through (g).

16. A method of modifying drilling conditions in a well bore to avoid sticking the drill pipe while drilling said well bore, said drilling conditions including measured variables related to the physical configuration of the drill pipe and the well hole and its fluid content, (a) prior to drilling said well bore measuring a multiplicity, M, of related well drilling variables in a multiplicity, N, of wells drilled under comparable drilling conditions in at least two different groups of wells, said measured variables being at a given depth in each well bore and said groups being where a drill string has either (i) become stuck during drilling or (ii) has been drilled through depth intervals of wells selected in (i) without sticking, (b) forming each of said groups of N wells in step (a) into a separate matrix in which each of said measured variables M is an element of $x_{ji}$ in a common group array (row or column), and said group matrix includes the complementary group array (row or column) for each of said N wells selected as a member of its respective group; where, in each of said following matrices and equations, j indexes any well in any group; i indexes any variable in any of said wells; and N is the number of wells in each group which need not necessarily be the same number in each group and M is the same number and type of variables in each group;

(c) in each of said groups forming a (average) Vector, $\overline{X}$HD i, of each variable in said group array to form a corresponding group Variance Vector, $S_i$: wherein said Mean Vector $\overline{X}_i$ is $$\overline{X}_i = 1/N \sum_{j=1}^{N} x_{ji}$$

where
j=1,2,3,—N (wells) and
i=1,2,3,—M (variables)
and said Variance Vector $S_i$ is:

$$S_i = 1/(N-1) \sum_{j=1}^{N} (X_{ji} - \overline{X}_i)^2$$

and the Standard deviation Vector $s_i$ of each element of said group is:

$$s_i = \left( 1/(N-1) \sum_{j=1}^{N} (X_{ji} - \overline{X}_i)^2 \right)^{\frac{1}{2}}$$

$$\text{or } s_i = \sqrt{S_i}$$

(d) forming the Correlation $r_{ik}$ wherein the value between any two variables, say $x_{ji}$ and $x_{jk}$ is defined as the group Variance-Covariance Matrix, $C_{ik}$ $$C_{ik} = \frac{1}{N-1} \sum_{j=1}^{N} (x_{ji} - \overline{X}_i)(x_{jk} - \overline{X}_k)$$

$$i, k = 1,2,3 \ldots [m]$$

and the Group Correlation Matrix, $R_{ik} = C_{ik}/s_i s_k$ to express the linear dependence or relationship, of said pair of x's, (say i=1, k=2) and so that each of said coefficients $R_{ik}$ is expressed in a square, symmetrical group matrix R where the i's and k's refer to each variable in the total population, and the Within Group Correlation Matrices are similarly defined so that the j's refer only to the members of the Group and the $\bar{X}$i's and $s_i$'s refer only to the mean and standard deviations of that group, (e) then similarly forming a weighted average of the Within Group Correlation Matrices $R_T$ in which said Correlation Matrices are generally symmetric, square and positive, semi-definite, (f) solving the matrix product, Q, of the inverse of the Within Group Correlations Matrix with the Between Group Correlation Matrix (Total Correlation Matrix minus Within Group Correlation matrix) such that the relations are:

T=A+W where

T=Total Correlation Matrix

A=Between Group Correlation Matrix

W=Within Group Correlation Matrix and $Q=W^{-1}A$ wherein $W^{-1}$ is the inverse of Matrix W and solving $$|(Q-\lambda_g I)|\nu g0=$$

wherein $\lambda_g$ are the eigenvalues (latent roots), $\nu$g, are associated eigenvectors, I is the identity matrix, and g is the number of roots which exist, i.e., minimum of (M,=number of variables and g=number of groups minus 1)

(g) multiplying each original measured variable element in the original matrix formed in accordance with step (b) by it corresponding eigenvector coefficient $\nu_g$ and separately summing the products for each array of measured variables for each well, (h) plotting the sums of said products for each well as a representation of the probability of each of said wells being correctly located in its assigned class and to locate the mean of each of said groups of wells;

(i) then multiplying and summing the products of $\nu_g$ for each measured variable in another well whose probability of sticking the drill string is to be determined and which is drilled within a geological province and over a depth interval similar to said multiplicity of wells;

(j) plotting the coordinates of the sum of said products for said other well to indicate relative to the group mean for at least said group of (i) wells of step (a) to indicate the probability of sticking the drill pipe in said other well;

(k) modifying a plurality of said measured variables in said other well in accordance with said coordinates to direct said well toward said group (ii) wells of step (a), and (1) drilling said other well after modification of at least one of said plurality of measured variables.

17. A method in accordance with claim 16 wherein the individual variables of said plurality of measured variables in said other well are modified in accordance with the extent of the contribution of each of said plurality of variables multiplied by its corresponding eigenvector coefficient to alter the location of said other well on the plot relative to said group of (i) wells of step (a).

* * * * *